US012618630B2

(12) United States Patent
Young et al.

(10) Patent No.: US 12,618,630 B2
(45) Date of Patent: May 5, 2026

(54) MODULAR FIREARM SUPPRESSOR

(71) Applicant: EVOLVED GEAR LLC, Boise, ID (US)

(72) Inventors: Nolan Blake Young, Boise, ID (US); Cory Newman, Smithfield, UT (US); Dean Sylvester, Boise, ID (US); Daniel Lankford, Namp, ID (US)

(73) Assignee: Evolved Gear LLC, Boise, ID (US)

( * ) Notice: Subject to any disclaimer, the term of this patent is extended or adjusted under 35 U.S.C. 154(b) by 106 days.

(21) Appl. No.: 18/305,812

(22) Filed: Apr. 24, 2023

(65) Prior Publication Data

US 2023/0341208 A1 Oct. 26, 2023

Related U.S. Application Data

(60) Provisional application No. 63/334,516, filed on Apr. 25, 2022.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223
See application file for complete search history.

(56) References Cited

U.S. PATENT DOCUMENTS 4,907,488 A * 3/1990 Seberger ..... F41A 21/30 89/14.4
6,575,074 B1 * 6/2003 Gaddini ..... F41A 21/30 89/14.4
7,596,900 B2 10/2009 Robinson
D604,793 S 11/2009 Fitzpatrick et al.
D641,824 S 7/2011 Gridelet
D641,825 S 7/2011 Gridelet
8,042,448 B1 10/2011 Sylvester
8,201,489 B2 6/2012 Juarez
D670,783 S 11/2012 Barrett
(Continued)

FOREIGN PATENT DOCUMENTS

EM 015056985-0001 4/2024
EM 015056985-0002 4/2024
EM 015056985-0003 4/2024

OTHER PUBLICATIONS

Design U.S. Appl. No. 29/914,284, filed Oct. 16, 2023 titled Firearm.

(Continued)

*Primary Examiner* — Jeremy A Luks
(74) *Attorney, Agent, or Firm* — Dinsmore & Shohl LLP

(57) ABSTRACT

A firearm suppressor that includes a mount configured to connect the firearm suppressor to a barrel of a firearm. The firearm suppressor includes a first module connected to the mount. The interior of the first module is a first chamber and the first module does not include a baffle. The firearm suppressor includes a second module connected to the first module. The second module includes a plurality of baffles and at least one peripheral pathway that bypasses a second baffle of the plurality of baffles by fluidly connecting an exterior of a first baffle of the plurality of baffles with an exterior of an exterior of a third baffle of the plurality of baffles. The firearm suppressor includes an end cap connected to the second module.

15 Claims, 23 Drawing Sheets

(56) References Cited

U.S. PATENT DOCUMENTS

| | | | | |
|---|---|---|---|---|
| 8,365,456 | B1 | 2/2013 | Shepard, Jr. | |
| D680,611 | S | 4/2013 | Emde | |
| 8,539,871 | B1 | 9/2013 | Burt et al. | |
| 8,590,197 | B1 | 11/2013 | Sylvester | |
| 8,615,918 | B2 | 12/2013 | Shepard, Jr. | |
| 8,745,909 | B1 | 6/2014 | Sylvester | |
| D719,234 | S | 12/2014 | Hochstrate | |
| 9,103,618 | B2 | 8/2015 | Daniel et al. | |
| D746,396 | S | 12/2015 | Folkestad, II | |
| 9,347,727 | B1 * | 5/2016 | Cler | F41A 21/30 |
| 9,372,038 | B1 | 6/2016 | Sylvester | |
| D778,384 | S | 2/2017 | Zlobin | |
| D780,875 | S | 3/2017 | Sylvester | |
| 9,625,225 | B2 | 4/2017 | Sylvester | |
| D788,251 | S | 5/2017 | Sylvester | |
| 9,733,031 | B1 | 8/2017 | Sylvester | |
| D808,486 | S | 1/2018 | Kafka | |
| 9,927,192 | B1 | 3/2018 | Sylvester | |
| 10,041,751 | B2 | 8/2018 | Sylvester | |
| 10,330,420 | B2 | 6/2019 | Kunsky et al. | |
| D870,836 | S | 12/2019 | Packard et al. | |
| D886,935 | S | 6/2020 | Shepard, Jr. | |
| D890,285 | S | 7/2020 | Tollefsbol | |
| 10,718,577 | B1 | 7/2020 | Sylvester | |
| D900,950 | S | 11/2020 | Tollefsbol | |
| 10,996,008 | B2 | 5/2021 | Eltan et al. | |
| 11,015,883 | B2 | 5/2021 | Sylvester | |
| 11,067,350 | B1 | 7/2021 | Shepard, Jr. | |
| 11,162,748 | B2 | 11/2021 | Noonan | |
| 11,162,751 | B2 | 11/2021 | Macy | |
| D972,678 | S | 12/2022 | Shepard, Jr. | |
| 11,656,041 | B1 | 5/2023 | Millard | |
| 11,656,049 | B2 | 5/2023 | Young | |
| 11,709,028 | B1 | 7/2023 | Vernon | |
| 11,740,040 | B2 | 8/2023 | Sylvester | |
| 12,215,948 | B2 | 2/2025 | Noonan | |
| 2008/0236017 | A1 | 10/2008 | Fitzpatrick | |
| 2012/0180624 | A1 * | 7/2012 | Troy | F41A 21/30 89/14.4 |
| 2016/0109205 | A1 * | 4/2016 | Coppinger | F41A 21/30 89/14.4 |
| 2018/0252489 | A1 * | 9/2018 | Parker | F41A 21/30 |
| 2018/0340750 | A1 * | 11/2018 | Mooty | F41A 21/34 |
| 2021/0341246 | A1 * | 11/2021 | Kunsky | F41A 21/30 |
| 2021/0381792 | A1 * | 12/2021 | Young | F41A 21/30 |
| 2022/0049920 | A1 * | 2/2022 | Kras | F41A 21/30 |
| 2025/0123073 | A1 | 4/2025 | Newman | |

OTHER PUBLICATIONS

Design U.S. Appl. No. 29/914,291, filed Oct. 16, 2023 titled Firearm.

Design U.S. Appl. No. 29/914,298, filed Oct. 16, 2023 titled Firearm.

Crane; Magpul Masada Rifle/Carbine Becomes the Bushmaster Adaptive Combat Rifle (ACR), Published: Feb. 22, 2008 (URL: https://defensereview.com/magpul-masada-riflecarbine-becomes-the-bushmaster-adaptive-combat-rifle-acr/).

U.S. Appl. No. 63/334,516, filed Apr. 25, 2022 titled Modular Firearm Suppressor.

* cited by examiner

MODULAR FIREARM SUPPRESSOR

CLAIM TO PRIORITY

This non-provisional patent application claims priority to and benefit of, under 35 U.S.C. § 119(e), U.S. Provisional Patent Application Ser. No. 63/334,516, filed Apr. 25, 2022 and titled "Modular Firearm Suppressor", all of which is incorporated by reference herein.

FIELD OF THE DISCLOSURE

The embodiments described herein relates to a modular firearm suppressor.

BACKGROUND

Description of the Related Art

A suppressor may be used to reduce the noise made during the discharge of a firearm. One example of a prior firearm suppressor is a housing that includes a series of baffles positioned within the housing. For example, the housing, also referred to as a can, may include a series of k-type baffles positioned within the can. The baffles are constructed to provide a series of chambers that permit the contraction and expansion of the gas created by the discharge of ammunition. Baffles include a central opening permitting a fired projectile to pass through the suppressor. The total number of baffles within the suppressor can change the suppression of the discharge of a firearm. However, the more total number of baffles, the longer the length and heavier the suppressor may become. The optimal length, weight, and number of total baffles for a firearm suppressor may change depending on the situation, the type of firearm, as well as the caliber of the firearm. Accordingly, there is a need to provide firearm suppressor that may modified by the addition or removal of baffles to change the configuration of the firearm. Other drawbacks and disadvantages may exist.

SUMMARY

The present disclosure is directed to a modular firearm suppressor that addresses at least some of the problems and disadvantages discussed above.

One embodiment of the disclosure is a firearm suppressor. The firearm suppressor includes a mount having a first central opening and a second central opening with a first central pathway through the mount from the first central opening to the second central opening. The mount is configured to be connected to a barrel of a firearm and the first central pathway is configured to be aligned with a bore of the barrel. The firearm suppressor includes a first module connected to the mount. The first module includes a third central opening and a fourth central opening with a second central pathway through the first module from the third central opening to the fourth central opening. The interior of the first module is a first chamber. The first module does not include a baffle and the second central pathway is aligned with the first central pathway.

The firearm suppressor includes a second module connected to the first module. The second module includes a fifth central opening and a sixth central opening with a third central pathway through the second module from the fifth central opening to the sixth central opening. The second module includes a plurality of baffles positioned along the third central pathway between the fifth central opening and the sixth central opening with each baffle of the plurality of baffles having a central aperture aligned with the third central pathway. The third central pathway is aligned with the second central pathway and the second module includes at least one peripheral pathway. The at least one peripheral pathway is not coaxially aligned with the third central pathway and the at least one peripheral pathway bypasses a second baffle of the plurality of baffles by fluidly connecting an exterior of a first baffle of the plurality of baffles with an exterior of an exterior of a third baffle of the plurality of baffles. The firearm suppressor includes an end cap connected to the second module. The end cap includes a seventh central opening and an eighth central opening with a fourth central pathway through the end cap from the seventh central opening to the eighth central opening with the fourth central pathway being aligned with the third central pathway.

The second module of the firearm suppressor may be formed via additive manufacturing. The plurality of baffles within the second module may comprise at least five baffles. The plurality of baffles within the second module may comprise at least nine baffles. The firearm suppressor may include a first modular baffle connected between the end cap and the second module. The first modular baffle may be connected to the second module via threads that create a taper lock between tapered edges of the first modular baffle and the second module. The firearm suppressor may include a second modular baffle connected between the first modular baffle and the end cap. The firearm suppressor may include a third modular baffle connected between the second modular baffle and the end cap. The firearm suppressor may include a fourth modular baffle connected between the third modular module and the end cap.

The first module and the second module may be formed by additive manufacturing process and the connector, the cap, the first modular baffle, the second modular baffle, the third modular baffle, and the fourth modular baffle may be formed by a machining process. The mount may be connected to the first module via threads configured to create a taper lock, wherein the first module is connected to the second module via threads and a taper lock is created between tapered edges of the first module and the second module, and wherein the second module is connected to the end cap via threads and a taper lock is created between tapered edges of the second module and the end cap. The firearm suppressor may include a blast baffle, wherein the blast baffle is threadedly connected to the first baffle of the plurality of baffles within the second module.

Figure 1:
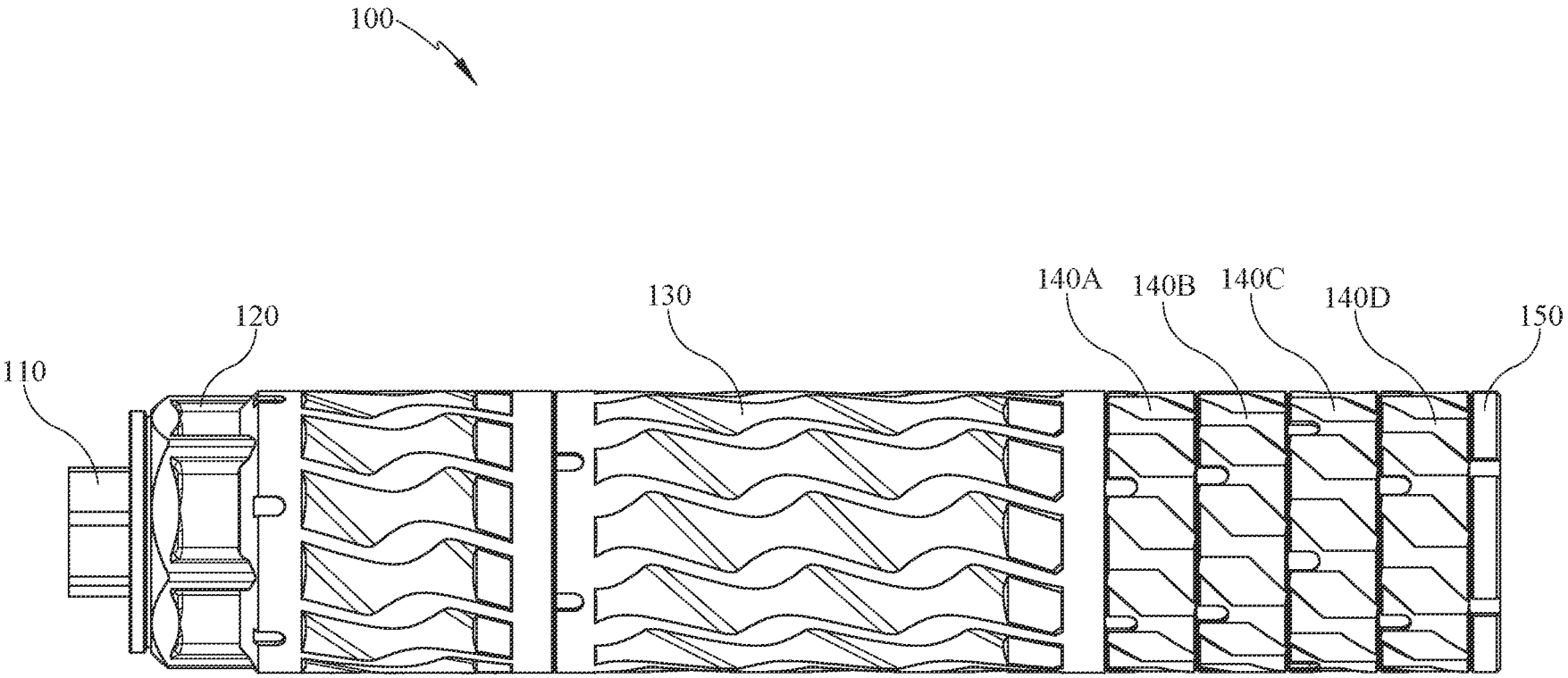
FIG. 1 shows a side view of an embodiment of a firearm suppressor.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows an embodiment of a firearm suppressor 100. The firearm suppressor 100 includes a mount 110 that is configured to connect the firearm suppressor 100 to the barrel of a firearm. For example, the mount 110 may be configured to thread onto the end of a threaded barrel. The mount 110 may be configured to connect to the barrel of a firearm arm in various ways as would be appreciated by one of ordinary skill in the art having the benefit of this disclosure. For example, the mount 110 may engage lugs on the end of a barrel to selectively connect the firearm suppressor 100 to the firearm.

The firearm suppressor 100 includes a first module 120 and a second module 130. The first and second modules 120, 130 may be formed via additive manufacturing as described herein. The first module 120 includes an entrance chamber that enables the expansion of gas from the discharge of a projectile in a firearm connected to the firearm suppressor 100. The second module 130 includes a plurality of internal baffles that are configured to discharge the sound from the discharge of a projectile in a firearm connected to the firearm suppressor 100 as would be appreciated by one of ordinary skill in the art having the benefit of this disclosure.

Figure 3:
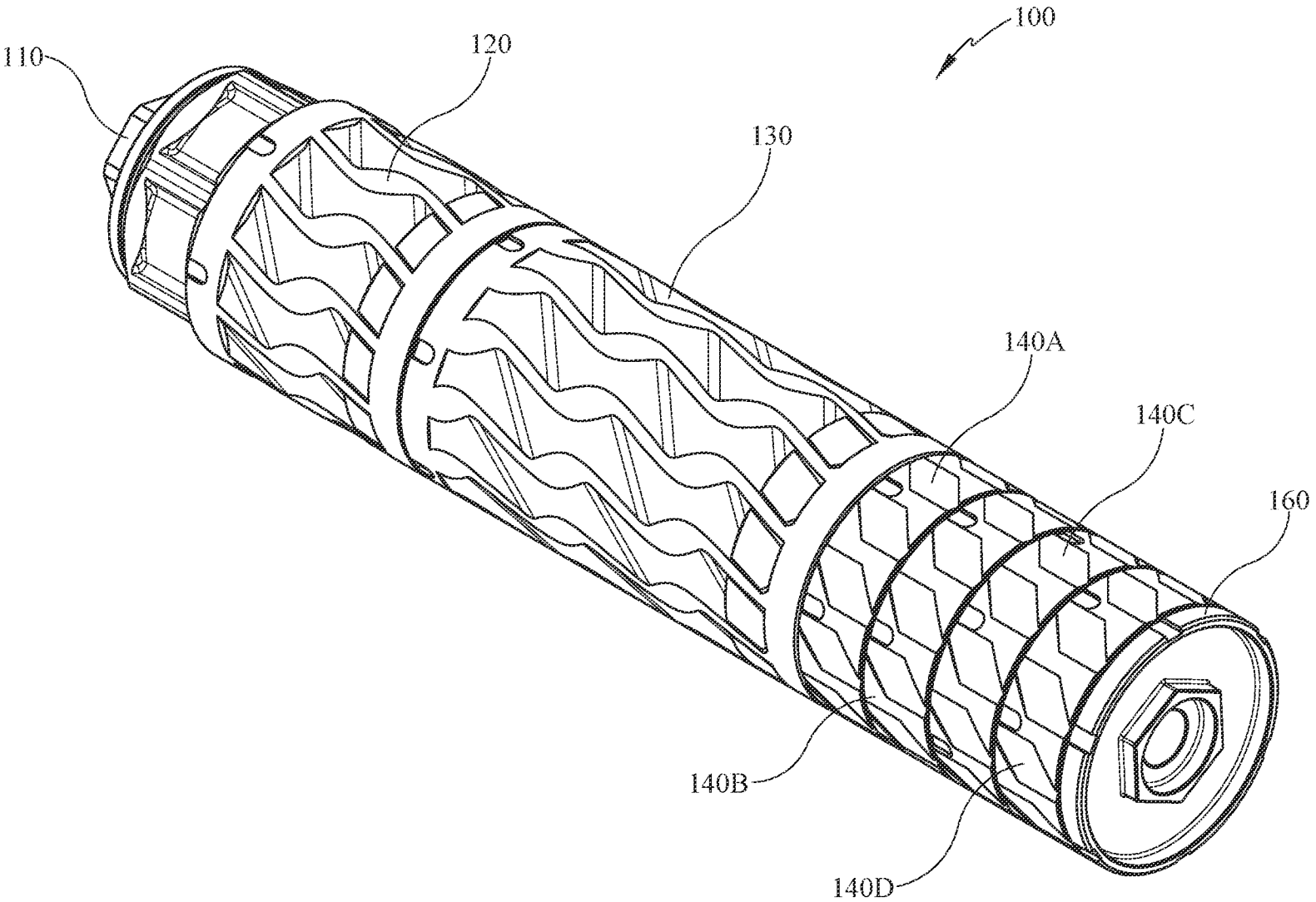
FIG. 3 is a perspective view of the firearm suppressor of FIG. 1.
Figure 4:
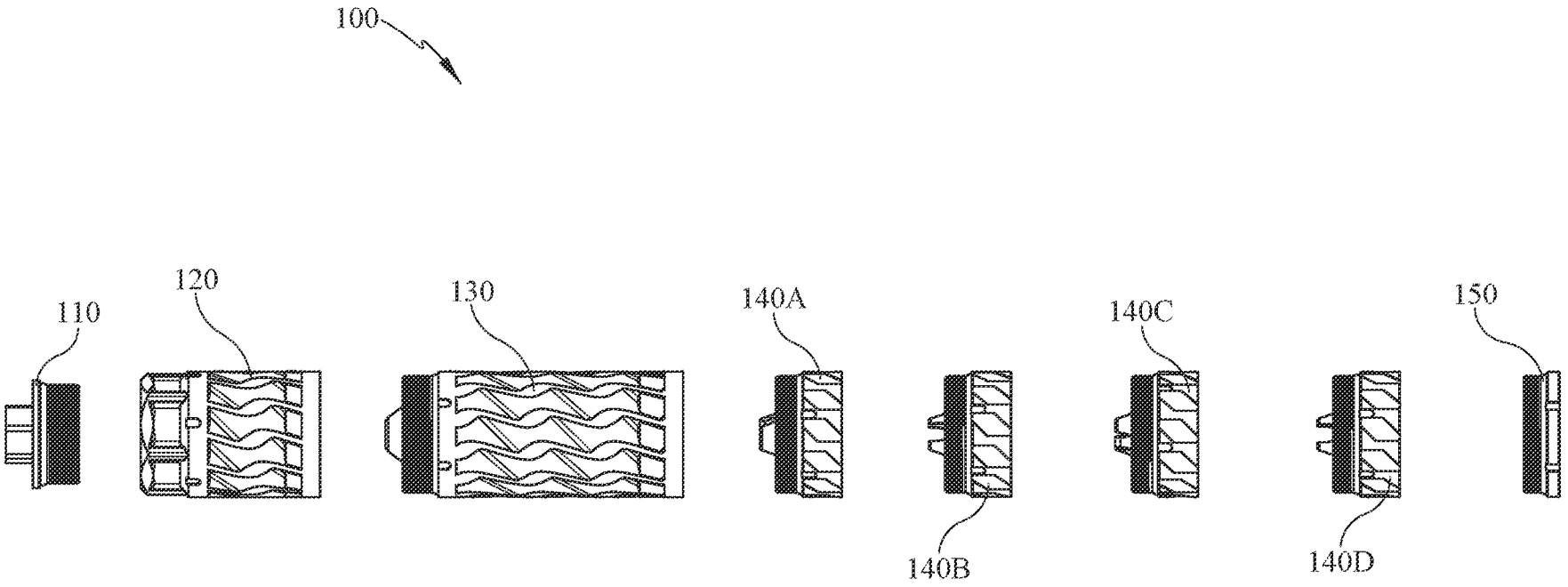
FIG. 4 is an exploded view of the firearm suppressor of FIG. 1.

The firearm suppressor 100 may include a plurality of modular baffles 140A-140D that are connected between the second module 130 and an end cap 150. There may be more or less than the four modular baffles 140A-140D as shown in FIGS. 1, 3, and 4 as would be appreciated by one of ordinary skill in the art having the benefit of this disclosure. For example, the end cap 150 may be threaded directly to the second module 130 and no modular baffles may be used with the firearm suppressor 100. In other embodiments, one, two, three, four, or more modular baffles 140A-140D may be threaded together and connected between the end cap 150 and the second module 130. The use of modular baffles enables the user to customize the length, weight, and/or performance of the firearm suppressor 100.

Figure 2:
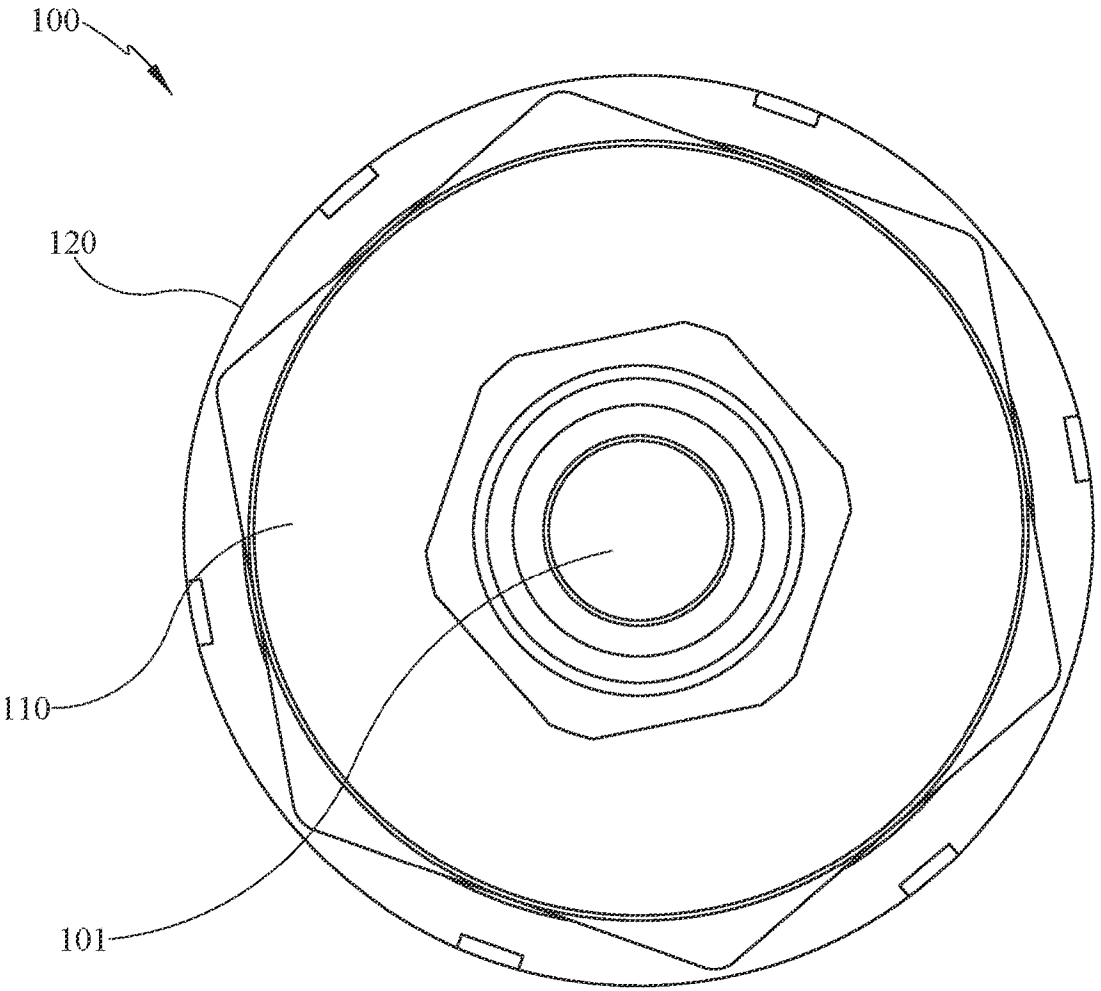
FIG. 2 is an end view of the firearm suppressor of FIG. 1.

FIG. 2 is an end view of the firearm suppressor 100 and shows that there is a projectile path 101 through the entire firearm suppressor 100. The projectile path 101 is formed by a first central pathway 115 (FIG. 6) of the mount 110, a second central pathway 125 (FIG. 7) of the first module 120, a third central pathway 135 of the second module 130, and a fourth central pathway 155 of the end cap 150 as discussed herein. If the firearm suppressor 100 includes modular baffles 140A-140D, the projectile path 101 includes a central pathway 145 (FIGS. 9-10) of each of the modular baffles 140A-140D.

Figure 5:
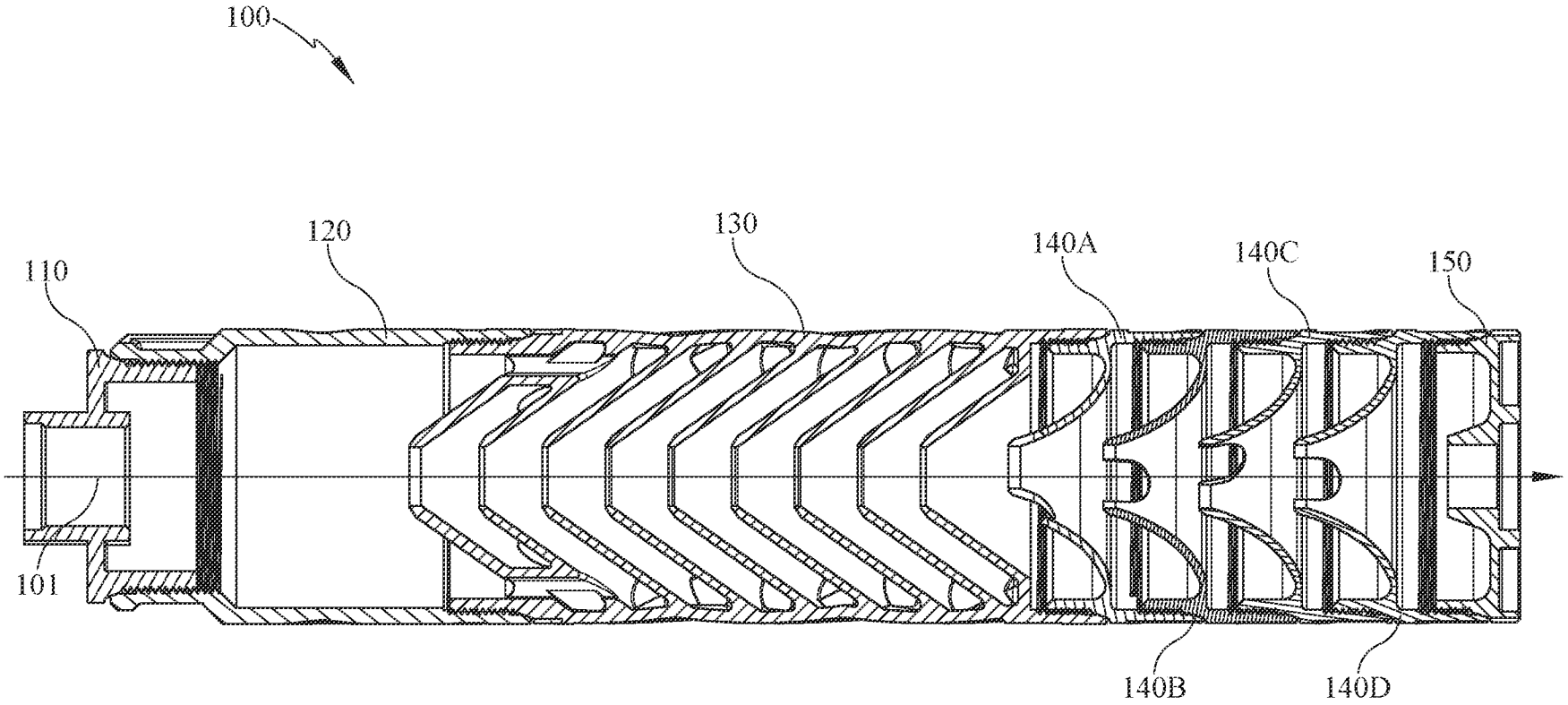
FIG. 5 is a cross-sectional view of the firearm suppressor of FIG. 1.

FIG. 3 shows a perspective view of the firearm suppressor 100 and FIG. 4 shows an exploded view of the firearm suppressor 100. FIG. 5 is a cross-sectional view of the firearm suppressor 100 and shows the projectile path 101 through each component of the firearm suppressor 100.

Figure 6:
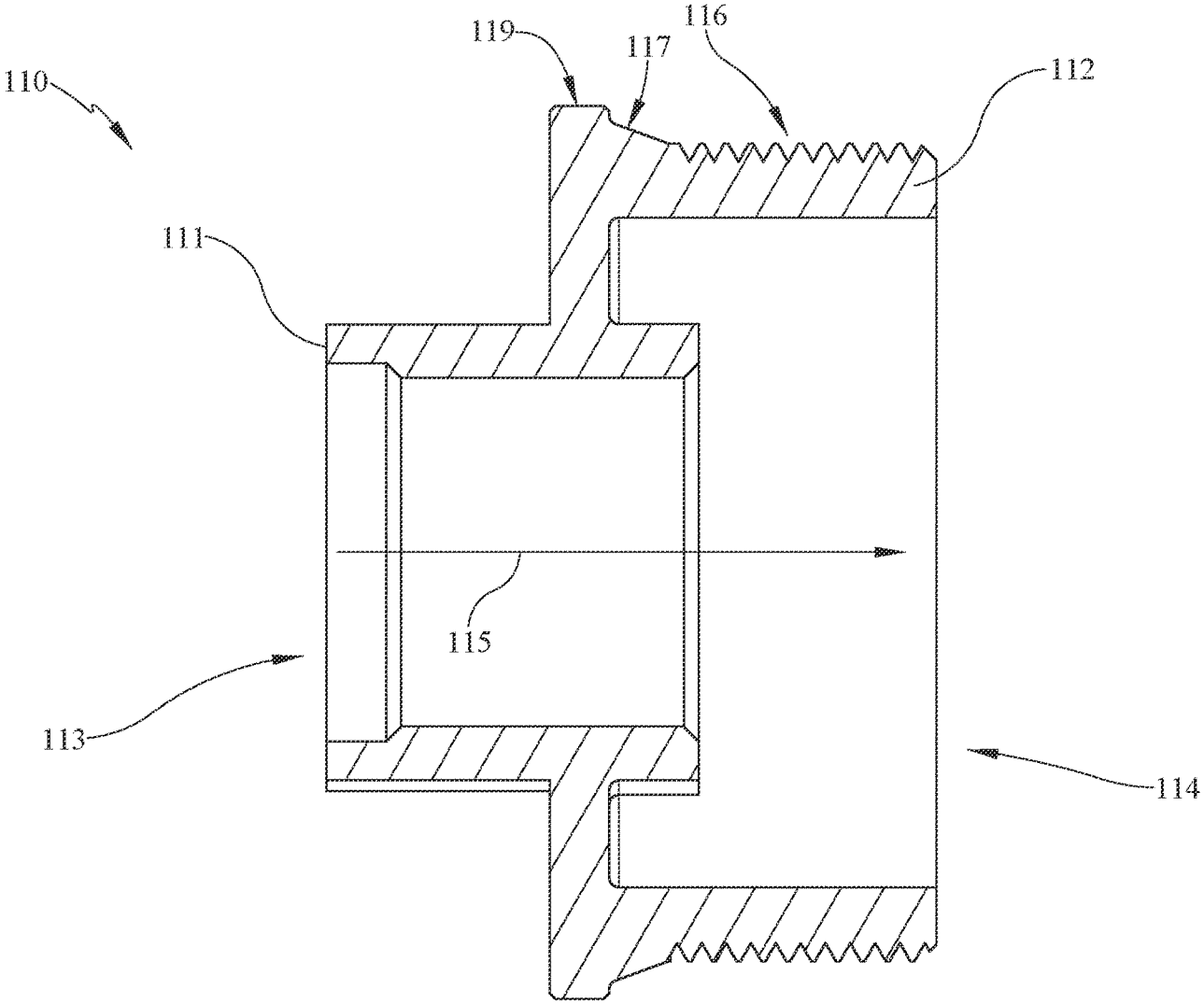
FIGS. 6-11 are cross-sectional views of various components of the firearm suppressor of FIG. 1.

FIG. 6 is a cross-sectional view of an embodiment of a mount 110. The mount 110 includes a first end 111 and a second end 112. The mount has a first central opening 113 and a second central opening 114 with a first central pathway 115 through the mount 110 from the first central opening 113 to the second central opening 114. The mount 110 is configured to be connected to a barrel of a firearm and the first central pathway 115 is configured to be aligned with a bore of the barrel. The mount 110 includes external threads 116 that enable it to be connected to another component of the firearm suppressor 100 such as the first module 120.

Adjacent to the external threads 116 and distal relative to the second end 112, the mount 110 comprises a tapered locking surface 117. The tapered locking surface 117 is engaged by the adjacent first module 120. The tapered locking surface 117 provides two advantageous functions. First, the taper lock engagement precludes backing off of the first module 120 from the mount 110. Second, the taper lock engagement provides a seal between the mount 110 and the first module 120. As a result a further advantage is that an o-ring is not needed between the mount 110 and the first module 120, and therefore the manufacturing is improved as well as a potential for o-ring failure is removed.

Adjacent to the tapered locking surface 117, a flange 119 provides a stop or abutment for the portion of the first module 120 which engages the tapered locking surface 117.

Figure 7:
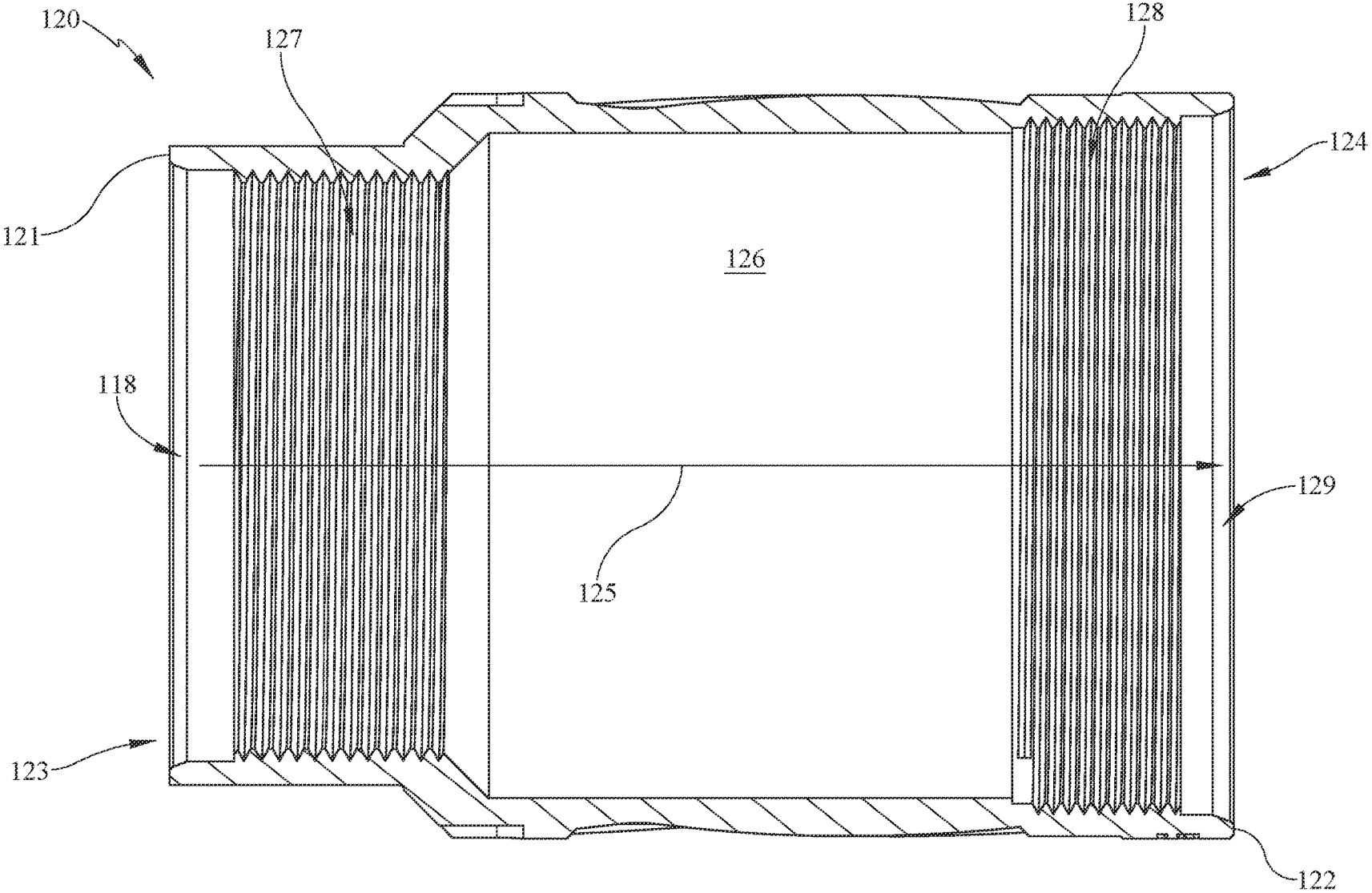

FIG. 7 is a cross-sectional view of an embodiment of a first module 120. The first module 120 has a first end 121 and a second end 122. The first module 120 is connected to the mount 110 via first internal threads 127. The first module 120 has a third central opening 123 and a fourth central opening 124 with a second central pathway 125 through the first module 120 from the third central opening 123 to the fourth central opening 124. The interior of the first module 120 is an expansion chamber 126. The first module 120 optionally does not include a baffle and the second central pathway 125 is aligned with the first central pathway 115 of the mount 110. The first module 120 includes second internal threads 128 that enable the first module 120 to be connected to another component of the firearm suppressor 100. For example, the first module 120 may be connected to the second module 130 via the second internal threads 128.

The first module 120 comprises a tapered engagement surface 118 which engages tapered locking surface 117. The first end 121 may engage the flange 119. The second end 122 also comprises a tapered engagement surface 129 for engagement with the second module 130.

Figure 8:
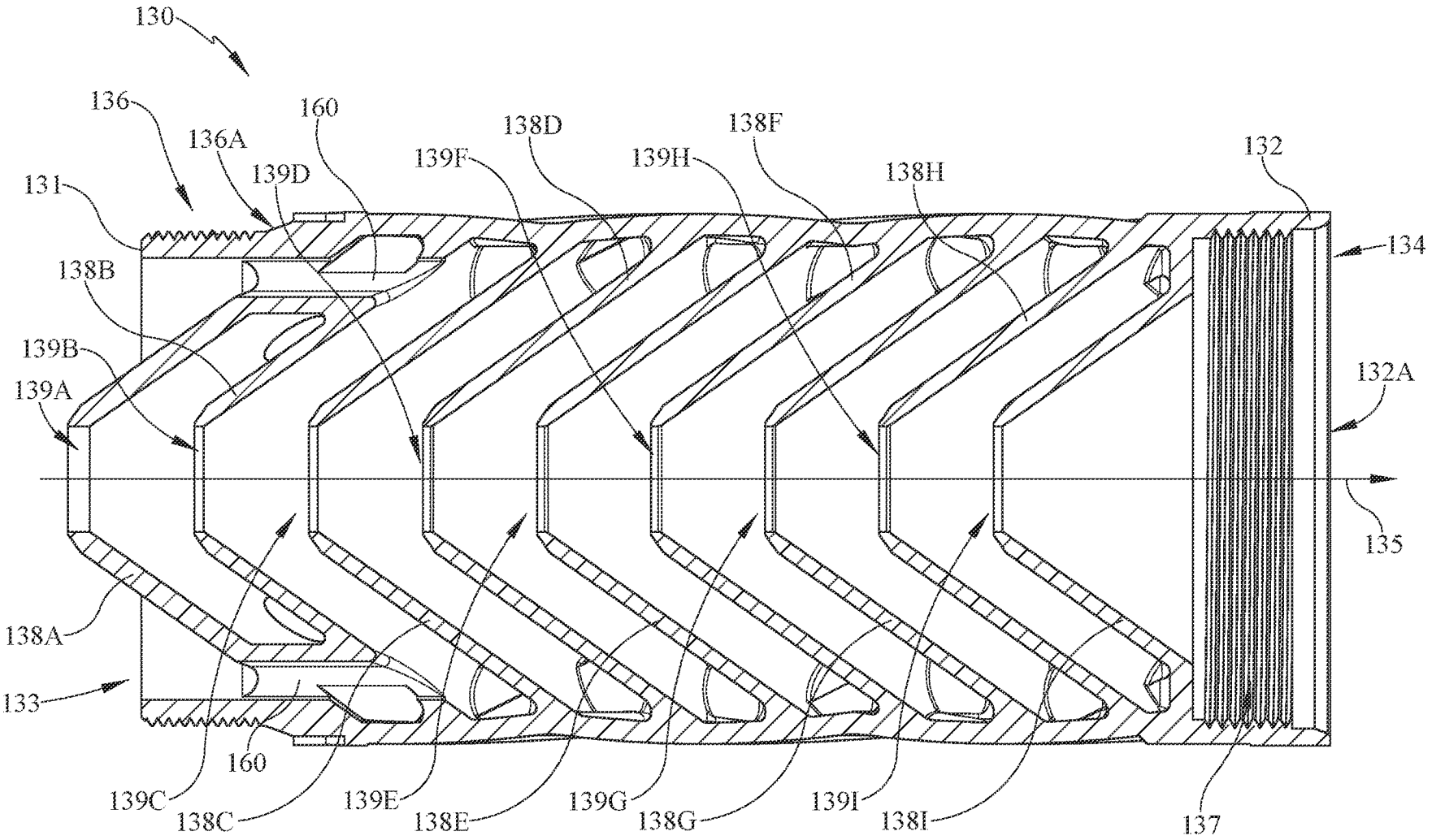

FIG. 8 is a cross-sectional view of an embodiment of a second module 130. The second module has a first end 131 and a second end 132. The second module 130 may be connected to the first module 120 (FIG. 7) via external threads 136 that engage the second internal threads 128 (FIG. 7) of the first module 120. The second module 130 includes a fifth central opening 133 and a sixth central opening 134 with a third central pathway 135 through the second module 130 from the fifth central opening 133 to the sixth central opening 134. The second module 130 includes a plurality of internal baffles 138A-138I positioned along the third central pathway 135 between the fifth central opening 133 and the sixth central opening 134. Each baffle 138A-138I includes a central aperture 139A-139I that is aligned with and forms the third central pathway 135. The third central pathway 135 is aligned with the second central pathway 125 of the first module 120 when the second module 130 is connected to the first module 120.

The second module 130 includes at least one peripheral pathway 160. The at least one peripheral pathway 160 is not coaxially aligned with the third central pathway 135. The at least one peripheral pathway 160 bypasses a second baffle 138B of the plurality of baffles 138A-138I by fluidly connecting an exterior of a first baffle 138A with an exterior of the third baffle 138C as shown in FIG. 8. The at least one peripheral pathway 160 provides a means to dissipate pressure and gas of the combustion. The at least one peripheral pathway 160 is designed to increase the volume of the entrance or expansion chamber 126 which is in communication with the at least one peripheral pathway 160. The increase in volume is designed to not increase the sound of the firearm and further to provide less back pressure on the firearm. With the at least one peripheral pathway in communication with the expansion chamber 126, the pathway 160 allows for bypass of the first and second baffles 138A, 138B. As shown, combustion gas will flow through the peripheral pathway 160 into the volume behind or downstream of the second baffle 138B, then travel downwardly toward the central pathway 135. This increases the distance traveled by the combustion gas and allows for further suppression, while increasing the volume of the expansion chamber 126.

In the section views of FIGS. 5 and 8, two peripheral pathways 160 are shown. However, there number of peripheral pathways may differ. For example there may be four (4) spaced apart at 90 degrees, or three (3) spaced apart at 120 degrees in some examples. In some other embodiments, the peripheral pathways 160 may not be symmetrical. The peripheral pathways 160 may be designed to be linear or may be helical or other shapes and may be longer in length or shorter in length depending on other design criteria for sound and back pressure. The shapes and volumes may be altered to decrease the sound of the suppressor and to decrease, or at least not increase, back pressure.

The second module 130 include internal threads 137 that enable the second module 130 to be connected to other components of the firearm suppressor 100. For example, the end cap 150 may be connected to the second end 132 of the second module 130 or alternatively, a modular baffle 140A may be connected to the second end 132 of the second module 130. The size, shape, number, and/or configuration of the internal baffles 138A-138I are shown for illustrative purposes and may be varied as would be appreciated by one of ordinary skill in the art having the benefit of this disclosure. For example, there may be more or less internal baffles 138A-138I as shown in FIG. 8.

Adjacent to the external threads 136 is a tapered locking surface 136A. The tapered engagement surface 129 engages the tapered locking surface 136A. Likewise, the opposite end 132 of the second module 130 has a tapered engagement surface 132A which engages the first modular baffle 140A.

Figure 9:
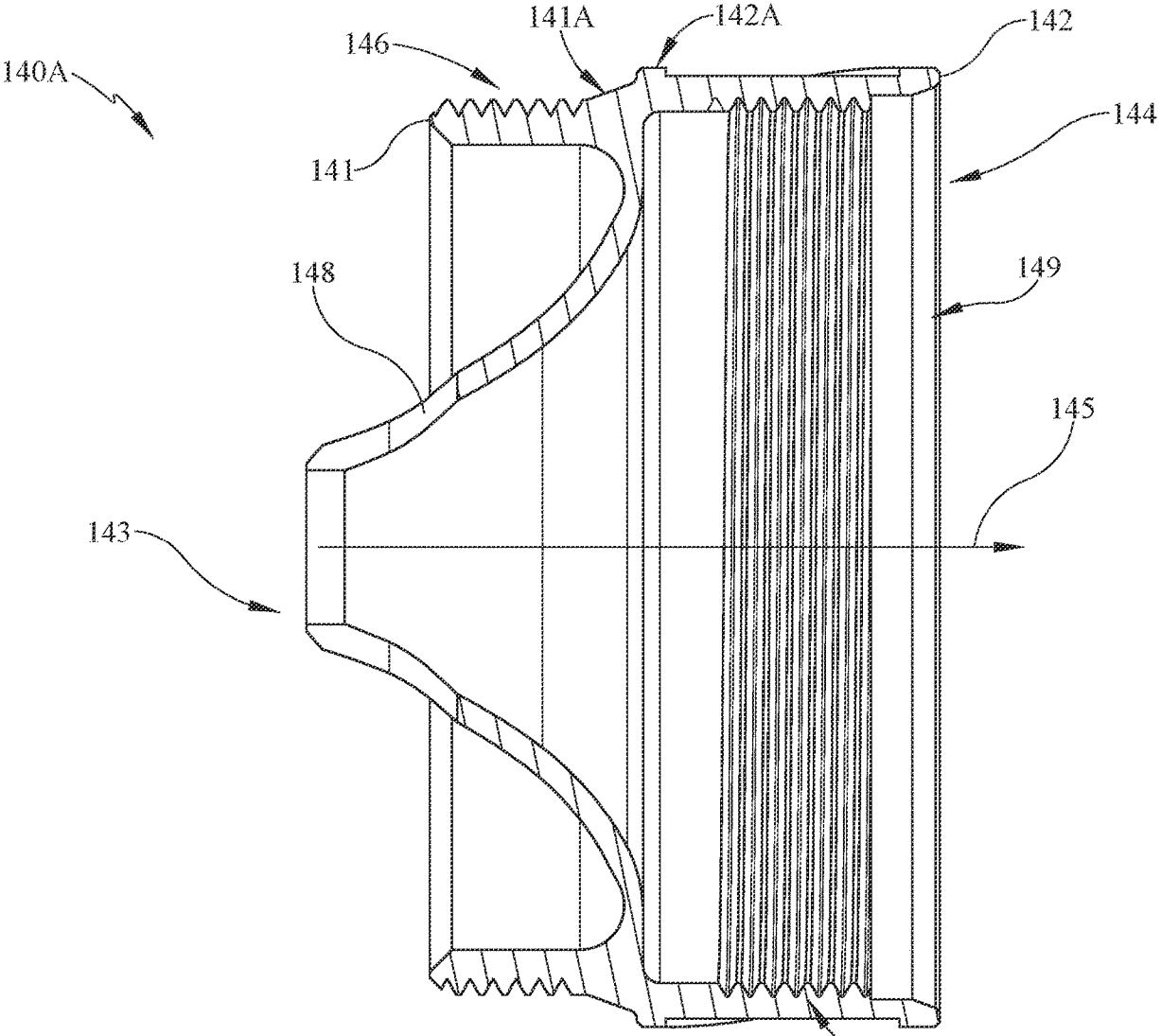

FIG. 9 is a cross-sectional view of an embodiment of a first modular baffle 140A. The modular baffle 140A includes a first end 141 and a second end 142. The modular baffle 140A has a first central opening 143 and a second central opening 144 with a central pathway 145 extending from the first central opening 143 to the second central opening 144. The modular baffle 140A includes external threads 146 to enable the modular baffle 140A to be connected to the second module 130 or to another modular baffle. The modular baffle 140A includes internal threads 147 that enable the modular baffle 140A to be connected to the end cap 150 or another modular baffle. The modular baffle 140A includes a cone 148 as would be appreciated by one of ordinary skill in the art having the benefit of this disclosure.

The modular baffle 140A may also comprise a tapered locking surface 141A which is disposed between the external threads 146 and the flange 142A. Further, at the second end 142, is a tapered engagement surface 149. This surface 149 can engage a corresponding tapered locking surface of an additional modular baffle or an end cap 150.

Figure 10:
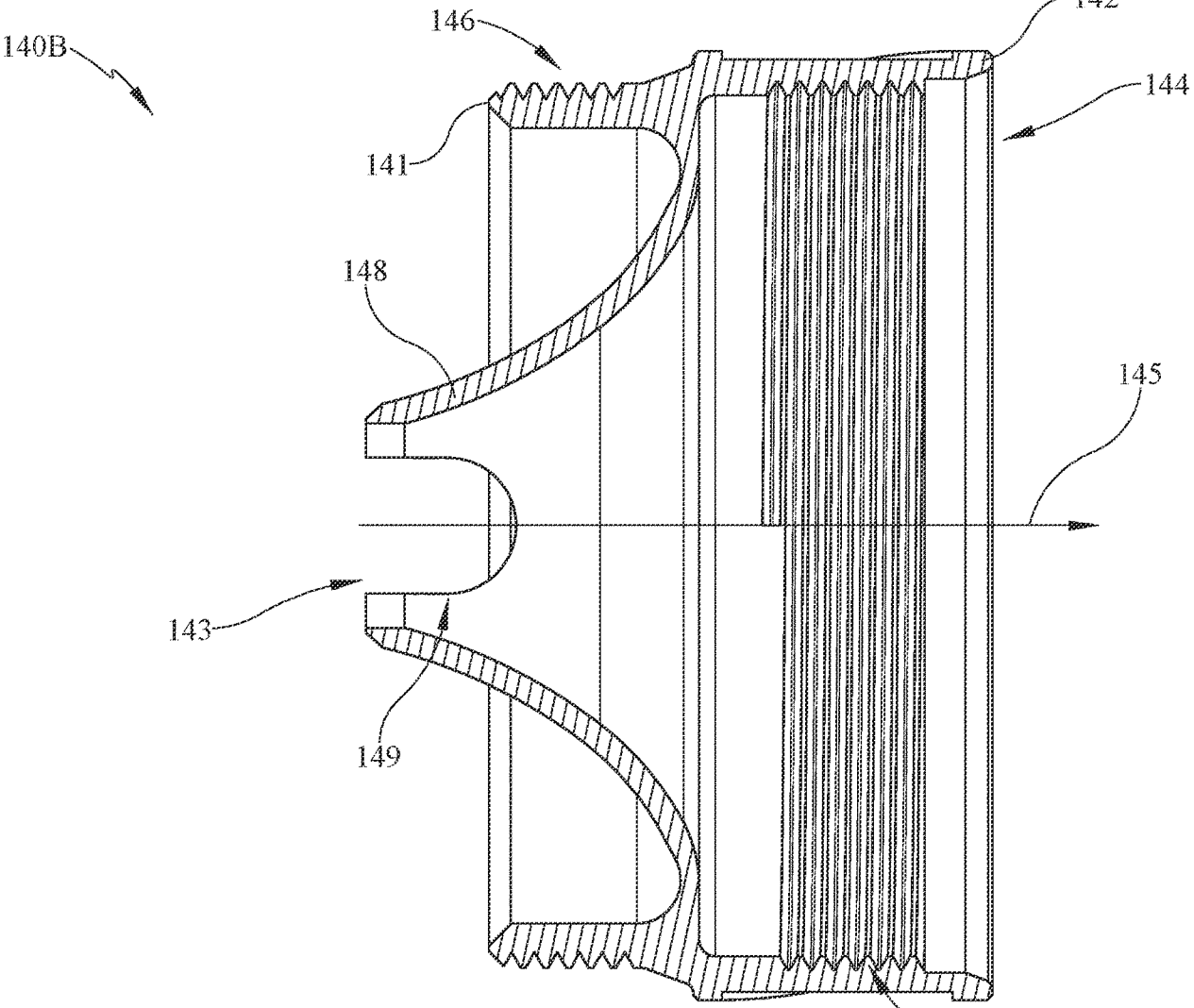

FIG. 10 is a cross-sectional view of an embodiment of a second modular baffle 140B. The modular baffle 140B includes a first end 141 and a second end 142. The modular baffle 140B has a first central opening 143 and a second central opening 144 with a central pathway 145 extending from the first central opening 143 to the second central opening 144. The modular baffle 140B includes external threads 146 to enable the modular baffle 140B to be connected to another modular baffle such as the first modular baffle 140A. The modular baffle 140B includes internal threads 147 that enable the modular baffle 140B to be connected to the end cap 150 or another modular baffle. The modular baffle 140B includes a cone 148 as would be appreciated by one of ordinary skill in the art having the benefit of this disclosure. The cone 148 may be clipped 149 as shown and as would be appreciated by one of ordinary skill in the art having the benefit of this disclosure.

Figure 11:
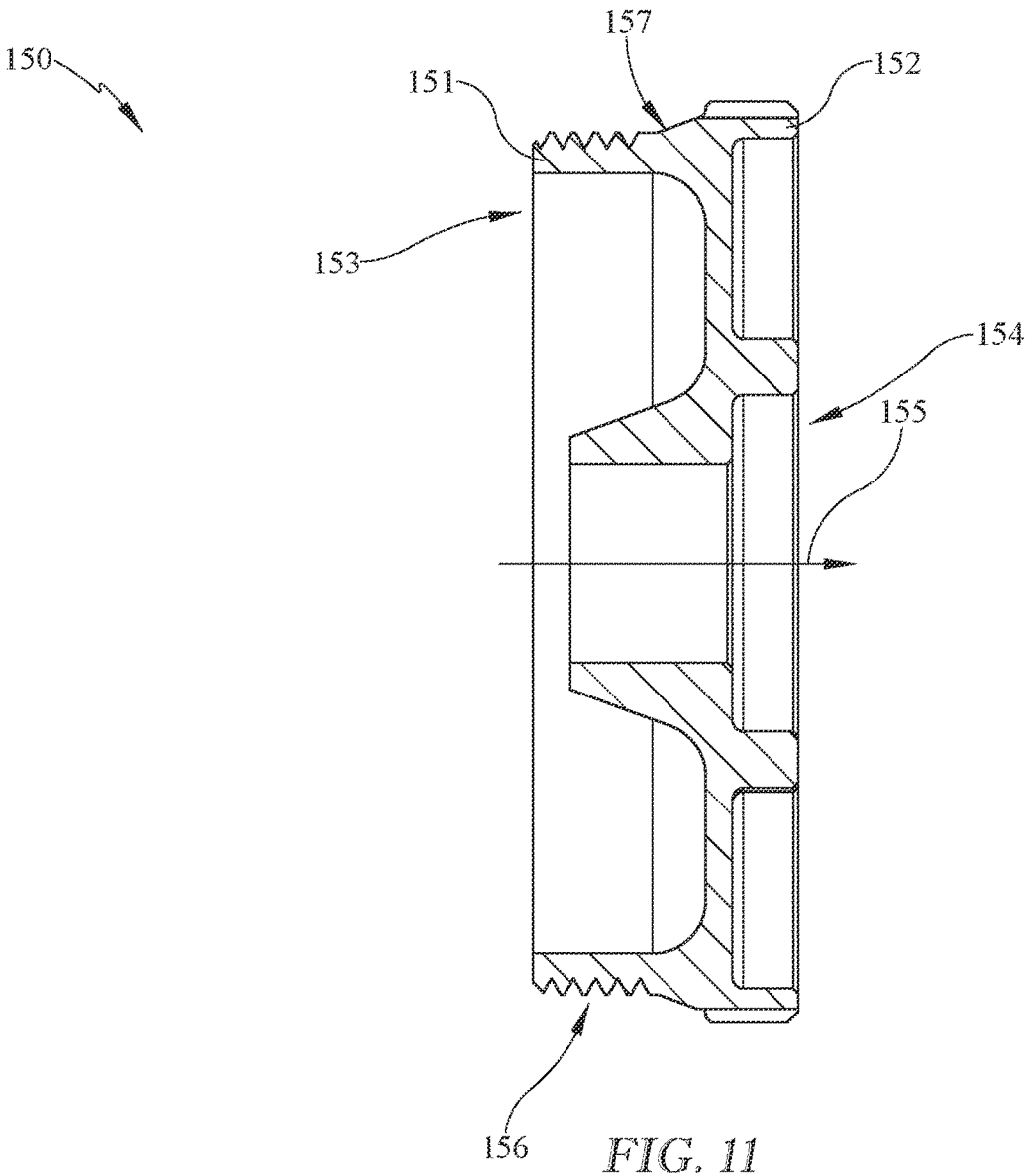

FIG. 11 is a cross-sectional view of an embodiment of an end cap 150. The end cap 150 includes a first end 151 and a second end 152. The end cap 150 has a seventh central opening 153 and an eighth central opening 154 with a fourth central pathway 155 through the end cap 150 from the seventh central opening 153 to the eighth central opening 154. The fourth central pathway 155 is aligned with the third central pathway 135 of the second module 130 when connected together. The end cap 150 includes external threads 156 that enable the end cap 150 to be connected directly to the internal threads 137 of the second module 130. Alternatively, the end cap 150 may be connected to a modular baffle 140A-140D via the external threads 156.

The end cap 150 may further comprise a tapered locking surface 157. The tapered locking surface 157 may be engaged by a corresponding tapered engagement surface. The end cap may also comprise a flange which functions as abutment as discussed in previous structures.

The firearm suppressor 100 may include components that are formed via additive manufacturing processes, such as but not limited to, 3D printing and the firearm suppressor 100 may include components that are formed via machining processes. For example, the first module 120 and the second module 130 of the firearm suppressor 100 may be formed via additive manufacturing processes whereas as the mount 110, modular baffles 140A-140D, and the end cap 150 may be formed via typical machining processes. The use of additive manufacturing enables the internal baffles 138A-138I to be formed at different spacing and/or angles. The use of two different manufacturing processes enables the firearm suppressor to be formed with differently shaped and configured baffles. The second module 130 ensures that a minimum number of baffles will be used along that length of the suppressor in comparison to a totally modular suppressor. A totally modular suppressor may enable an end user to reduce the total number of baffles to be less than the manufacturers' recommendations. For example, a user could remove modular baffles to just a couple or even one baffle, which may drastically affect the performance of the suppressor. The second module 130 of this disclosure ensures an adequate number of baffles will be used at a minimum while enabling the end user to reconfigure with the modular baffles 140A-140D.

The threads 116, 127, 128, 136, 137, 146, 147, 156 on each component of the firearm suppressor 100 may be configured to taper lock the components together. The threads may be configured to push the tapered edges into each other to create a taper lock due to the angle of the tapers of the tapered locking surfaces and the tapered engagement surfaces. The taper lock may provide an interference fit to prevent or reduce the chance that the components would inadvertently come apart or separate during repeated discharges of a firearm connected to the firearm suppressor 100. Additionally, the tapered engagements created sealed surfaces which limit or preclude escape of gases, as well as eliminate the need for the use of o-rings between modules, baffles, and/or end caps.

Figure 12:
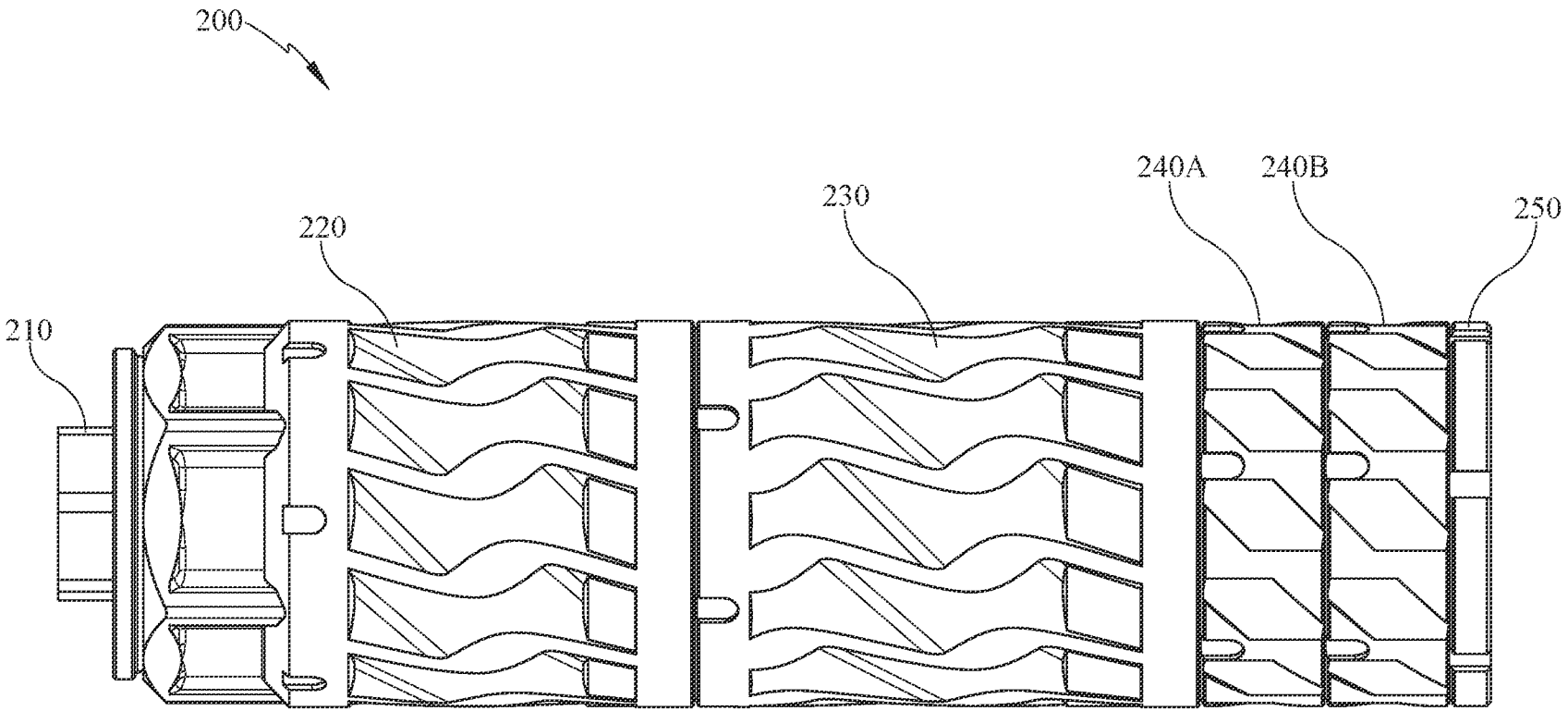
FIG. 12 shows an embodiment of a firearm suppressor.

FIG. 12 shows an embodiment of a firearm suppressor 200. The firearm suppressor 200 includes a mount 210 that is configured to connect the firearm suppressor 200 to the barrel of a firearm. For example, the mount 210 may be configured to thread onto the end of a threaded barrel. The mount 210 may be configured to connect to the barrel of a firearm arm in various ways as would be appreciated by one of ordinary skill in the art having the benefit of this disclosure. For example, the mount 210 may engage lugs on the end of a barrel, or an adapter, to selectively connect the firearm suppressor 200 to the firearm.

The firearm suppressor 200 includes a first module 220 and a second module 230. The first and second modules 220, 230 may be formed via additive manufacturing as described herein. The first module 220 includes an entrance chamber that enables the expansion of gas from the discharge of a projectile in a firearm connected to the firearm suppressor 200. The second module 230 includes a plurality of internal baffles that are configured to discharge the sound from the discharge of a projective in a firearm connected to the firearm suppressor 200 as would be appreciated by one of ordinary skill in the art having the benefit of this disclosure.

Figure 14:
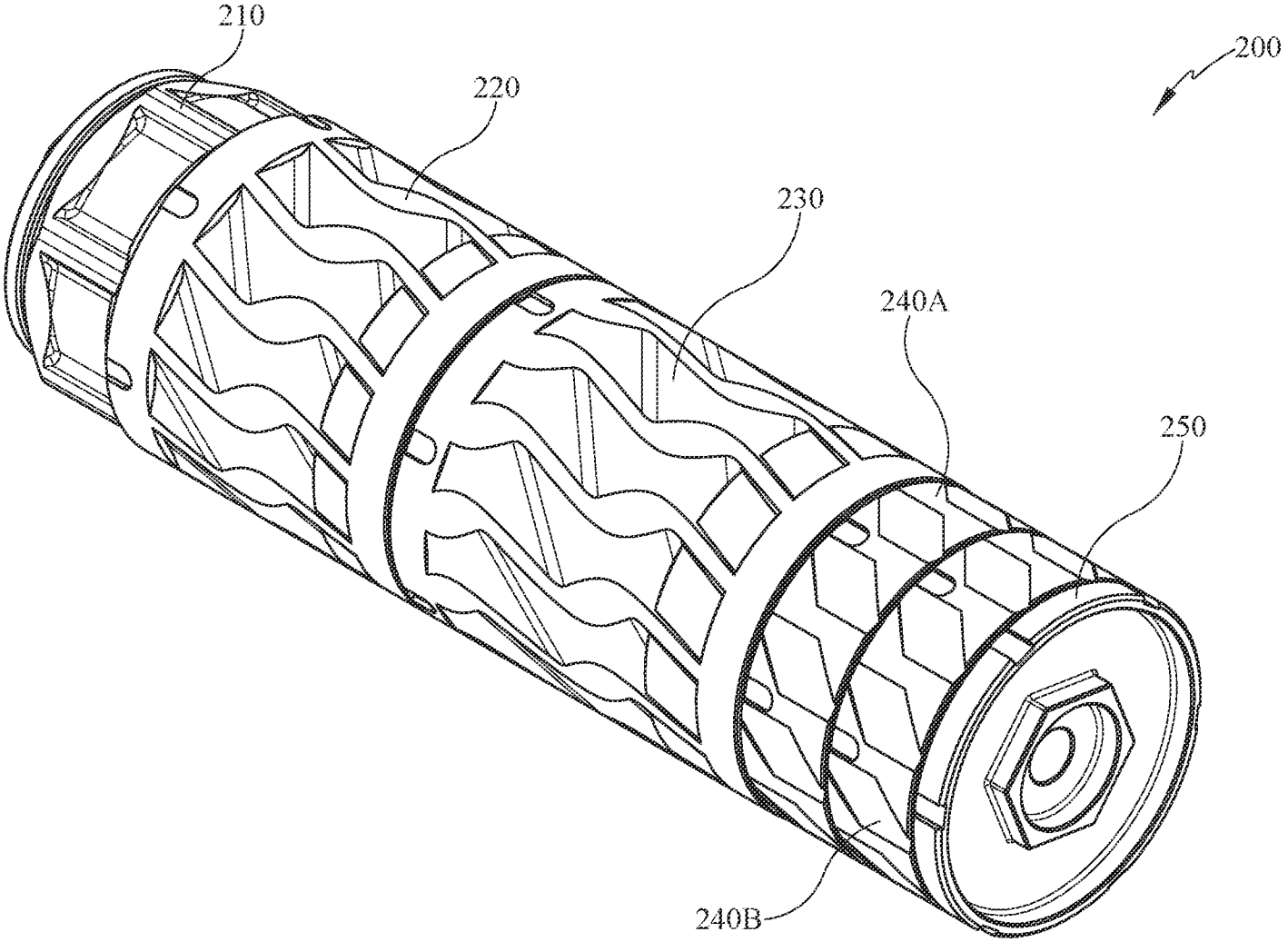
FIG. 14 is a perspective view of the firearm suppressor of FIG. 12.
Figure 15:
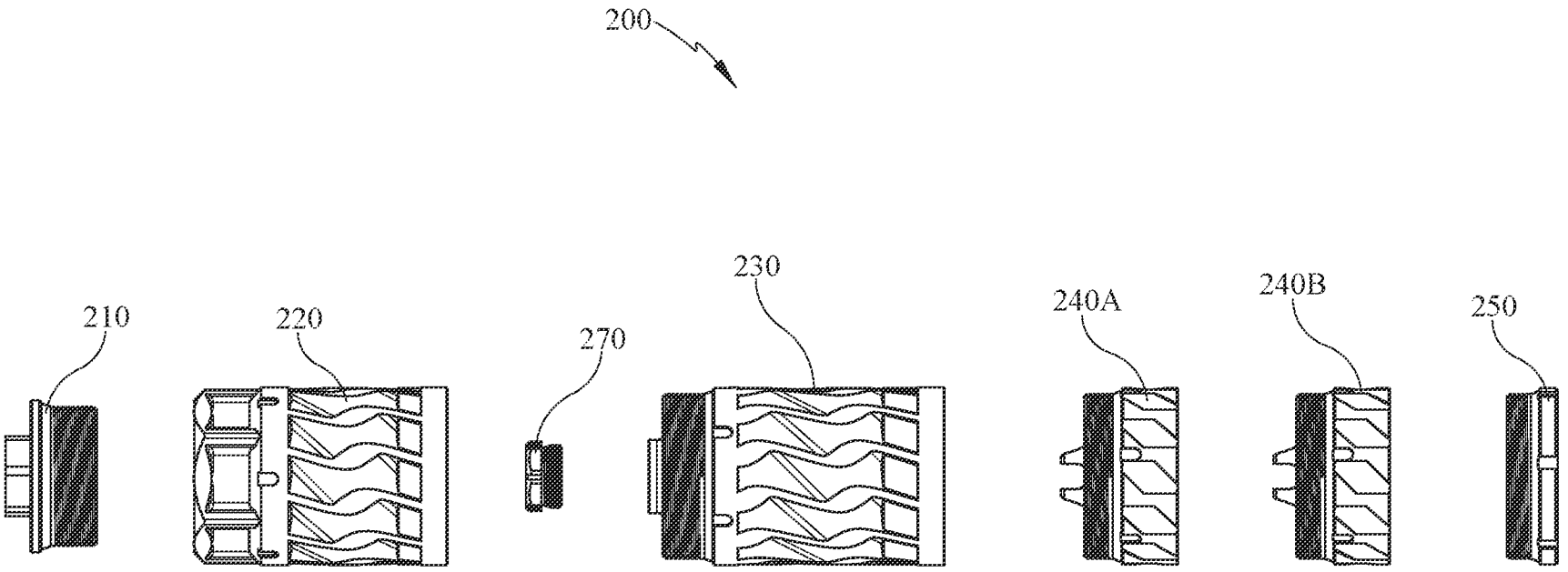
FIG. 15 is an exploded side view of the firearm suppressor of FIG. 12.

The firearm suppressor 200 may include a plurality of modular baffles 240A, 240B that are connected between the second module 230 and an end cap 250. There may be more or less than the two modular baffles 240A, 240B as shown in FIGS. 12, 14, and 15 as would be appreciated by one of ordinary skill in the art having the benefit of this disclosure. For example, the end cap 250 may be threaded directly to the second module 230 and no modular baffles may be used with the firearm suppressor 200. In other embodiments, one, two, or more modular baffles 240A, 240B may be threaded together and connected between the end cap 250 and the second module 230. The use of modular baffles enables the user to customize the length, weight, and/or performance of the firearm suppressor 200.

Figure 13:
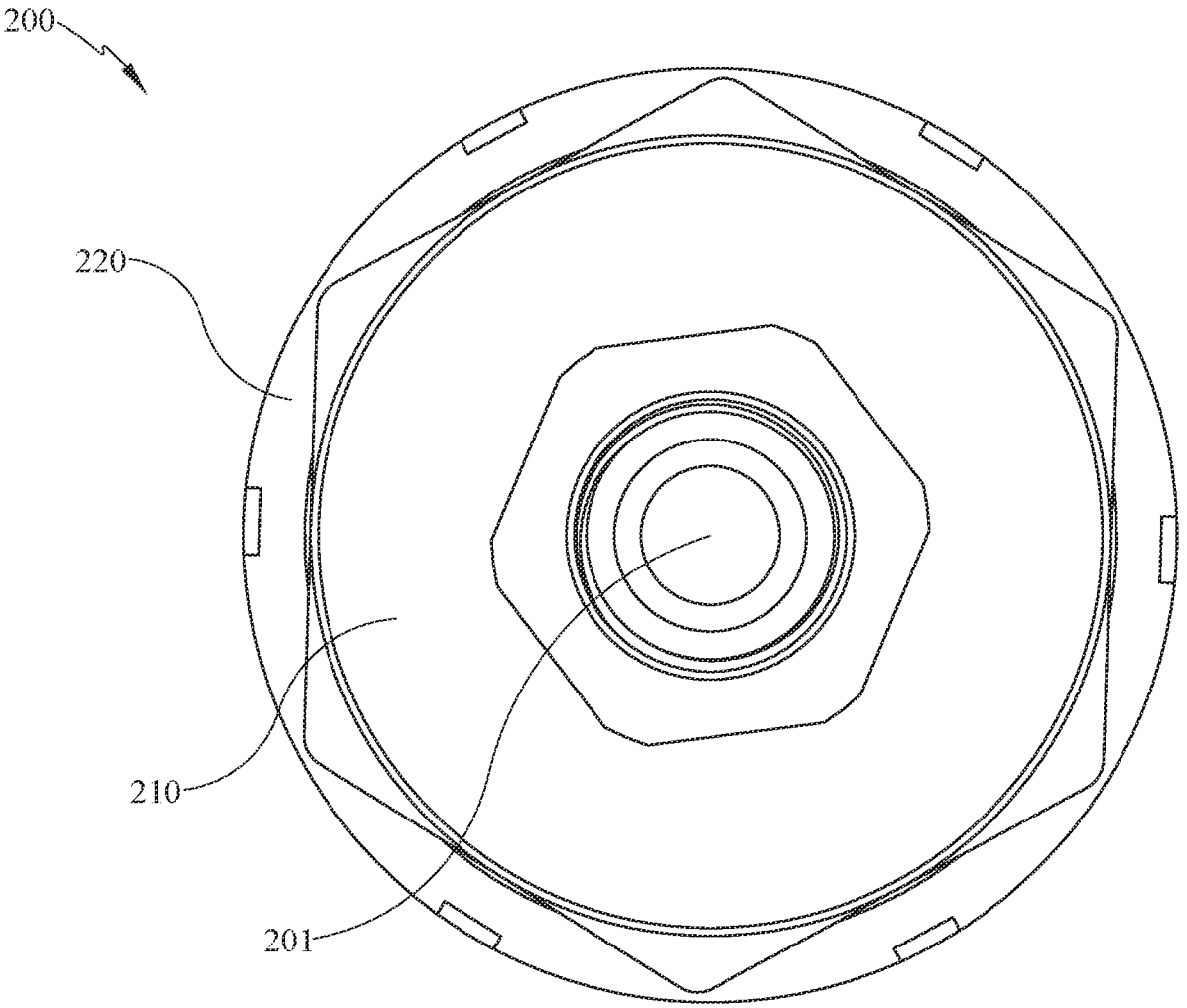
FIG. 13 is an end view of the firearm suppressor of FIG. 12.

FIG. 13 is an end view of the firearm suppressor 200 and shows that there is a projectile path 201 through the entire firearm suppressor 200. The projectile path 201 is formed by a first central pathway 215 of the mount 210, a second central pathway 225 of the first module 220, a third central pathway 235 of the second module 230, and a fourth central pathway 255 of the end cap 250 as discussed herein. If the firearm suppressor 100 includes modular baffles 240A, 240B, the projectile path 201 includes a central pathway 245 of each of the modular baffles 240A, 240B.

Figure 16:
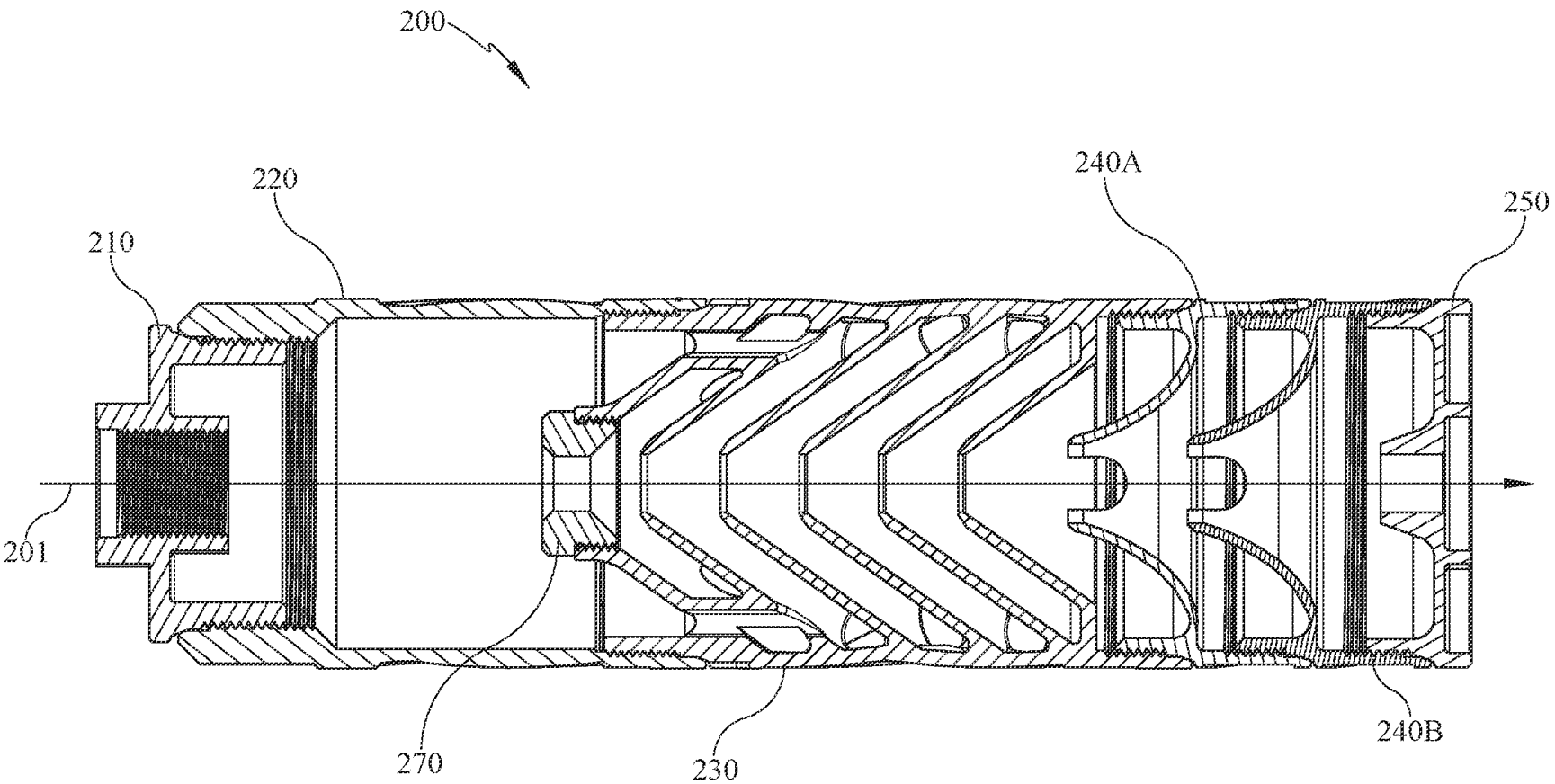
FIG. 16 is a cross-sectional view of the firearm suppressor of FIG. 12.

FIG. 14 shows a perspective view of the firearm suppressor 200 and FIG. 15 shows an exploded view of the firearm suppressor 200. FIG. 16 is a cross-sectional view of the firearm suppressor 200 and shows the projectile path 201 through each component of the firearm suppressor 200.

Figure 17:
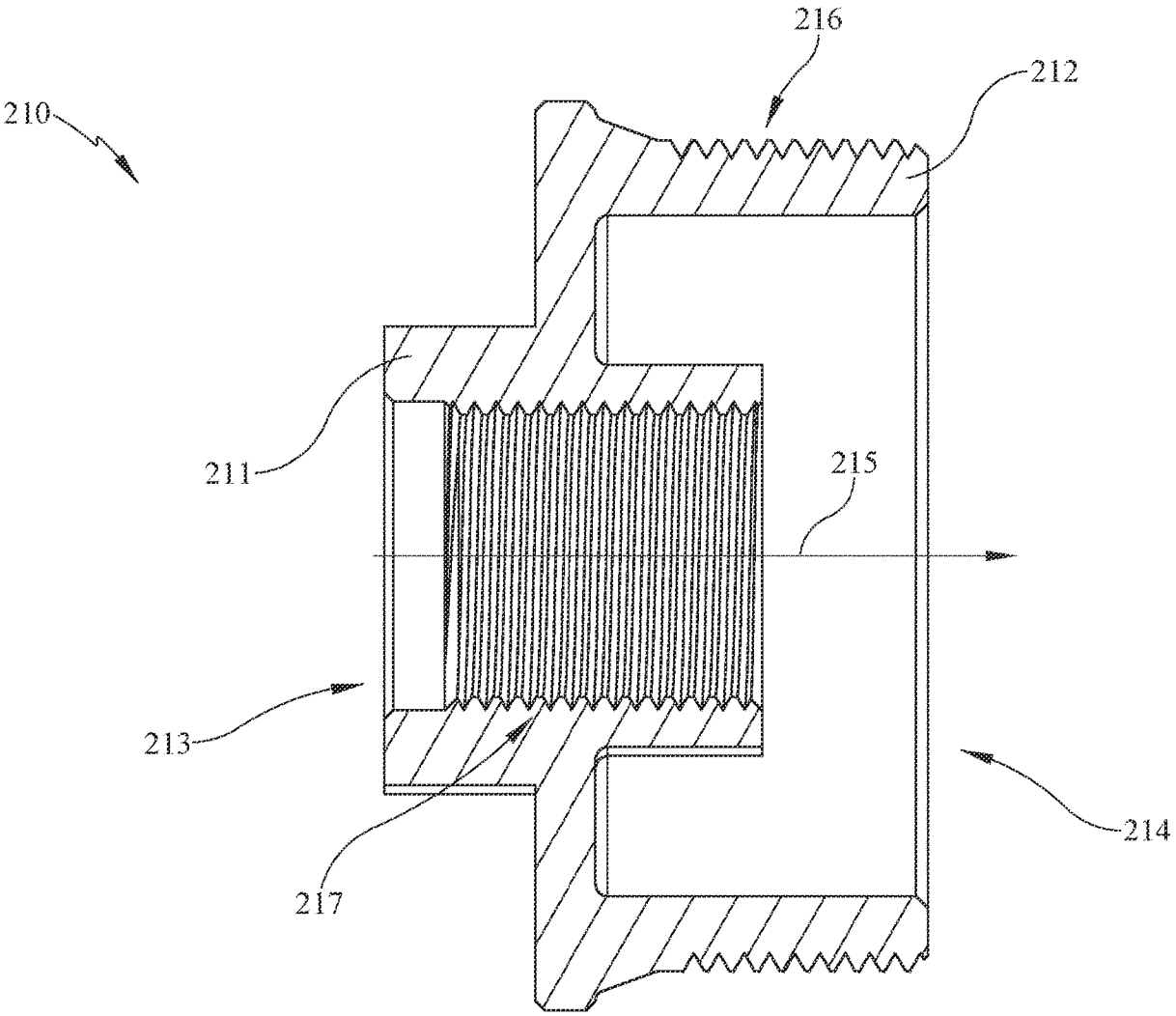
FIGS. 17-23 are cross-sectional views of various components of the firearm suppressor of FIG. 12.

FIG. 17 is a cross-sectional view of an embodiment of a mount 210. The mount 210 includes a first end 211 and a second end 212. The mount 210 has a first central opening 213 and a second central opening 214 with a first central pathway 215 through the mount 210 from the first central opening 213 to the second central opening 214. The mount 210 is configured to be connected to a barrel of a firearm and the first central pathway 215 is configured to be aligned with a bore of the barrel. For example, the mount 210 may include internal threads 217 that enable the mount 210 to be connected to a threaded barrel of a firearm. The mount 210 includes external threads 216 that enable it to be connected to another component of the firearm suppressor 200 such as the first module 220. The suppressor 200 may also comprise a plurality of tapered locking surfaces and tapered engagement surfaces which function as previously described.

Figure 18:
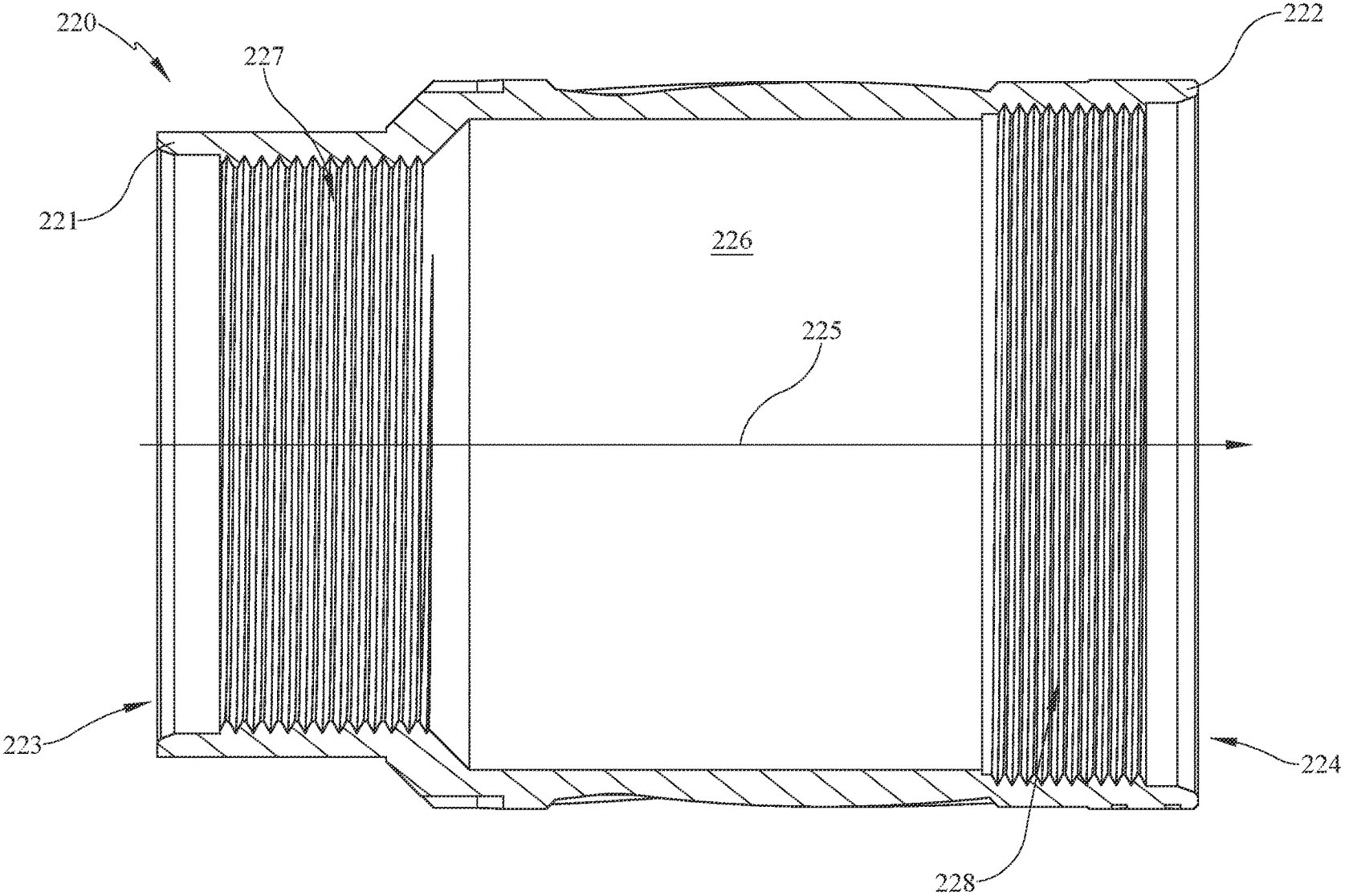

FIG. 18 is a cross-sectional view of an embodiment of a first module 220. The first module 220 has a first end 221 and a second end 222. The first module 220 is connected to the mount 210 via first internal threads 227. The first module 220 has a third central opening 223 and a fourth central opening 224 with a second central pathway 225 through the first module 220 from the third central opening 223 to the fourth central opening 224. The interior of the first module 220 is an expansion chamber 226. The first module 220 does not include a baffle and the second central pathway 225 is aligned with the first central pathway 215 of the mount 210. The first module 220 includes second internal threads 228 that enable the first module 220 to be connected to another component of the firearm suppressor 200. For example, the first module 220 may be connected to the second module 230 via the second internal threads 228.

Figure 19:
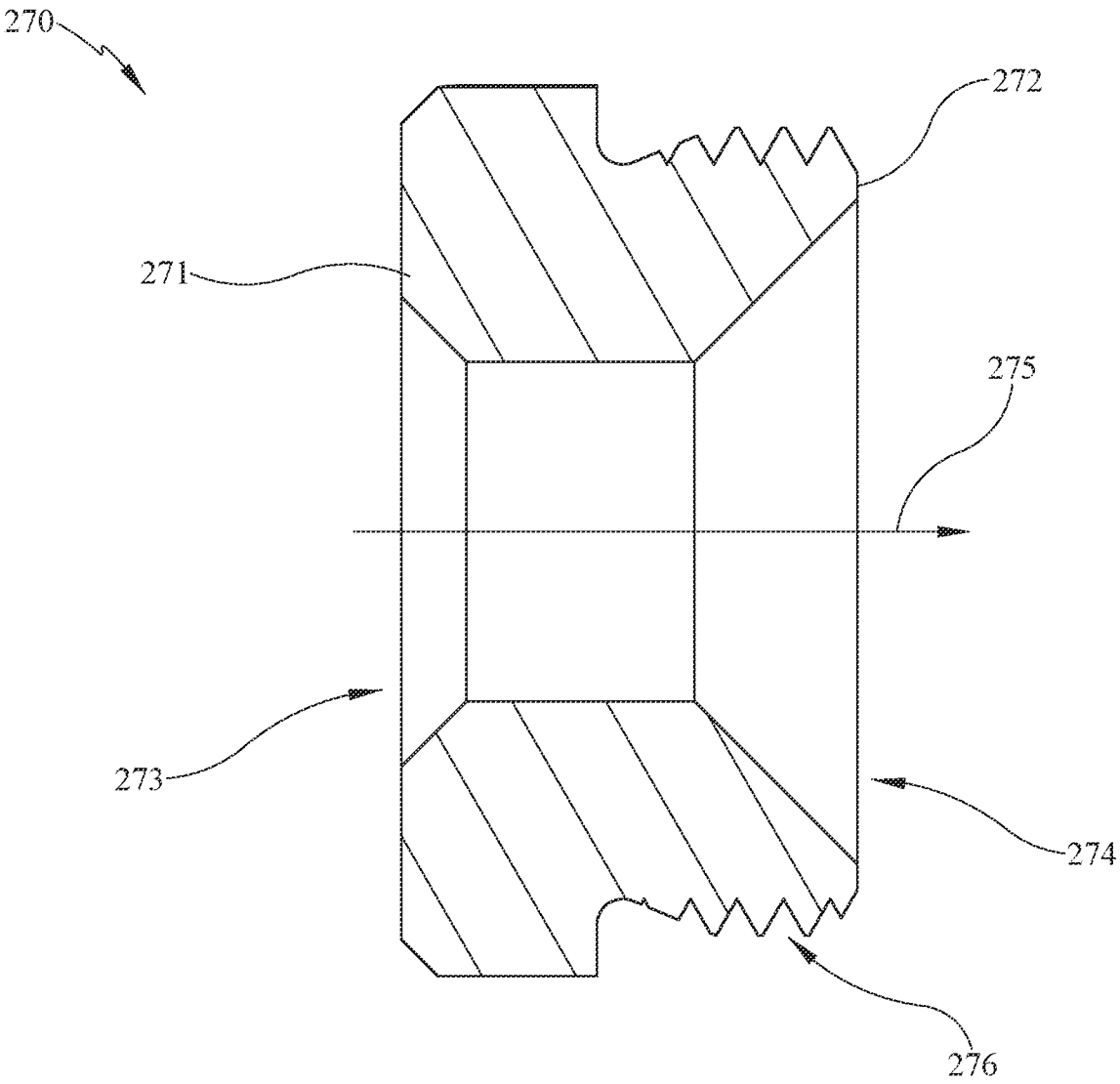

FIG. 19 is a cross-sectional view of an embodiment of a blast baffle 270. The blast baffle 270 includes a first end 271 and a second end 272. The blast baffle 270 includes a first central opening 273 and a second central opening 274 with a central pathway 275 that extends from the first central opening 273 to the second central opening 274. The blast baffle 270 includes external threads 276 that are configured to enable the blast baffle 270 to be threaded into the internal baffle 238A of the second module 230 as discussed herein. In some embodiments, the blast baffle 270 may have an exterior that is conical in shape, expanding in diameter in the direction of movement of a projectile through the suppressor. In other embodiments, for example as depicted, the blast baffle may have an exterior which is hexagonal in shape. Still other shapes may be utilized and these examples are not limiting.

Figure 20:
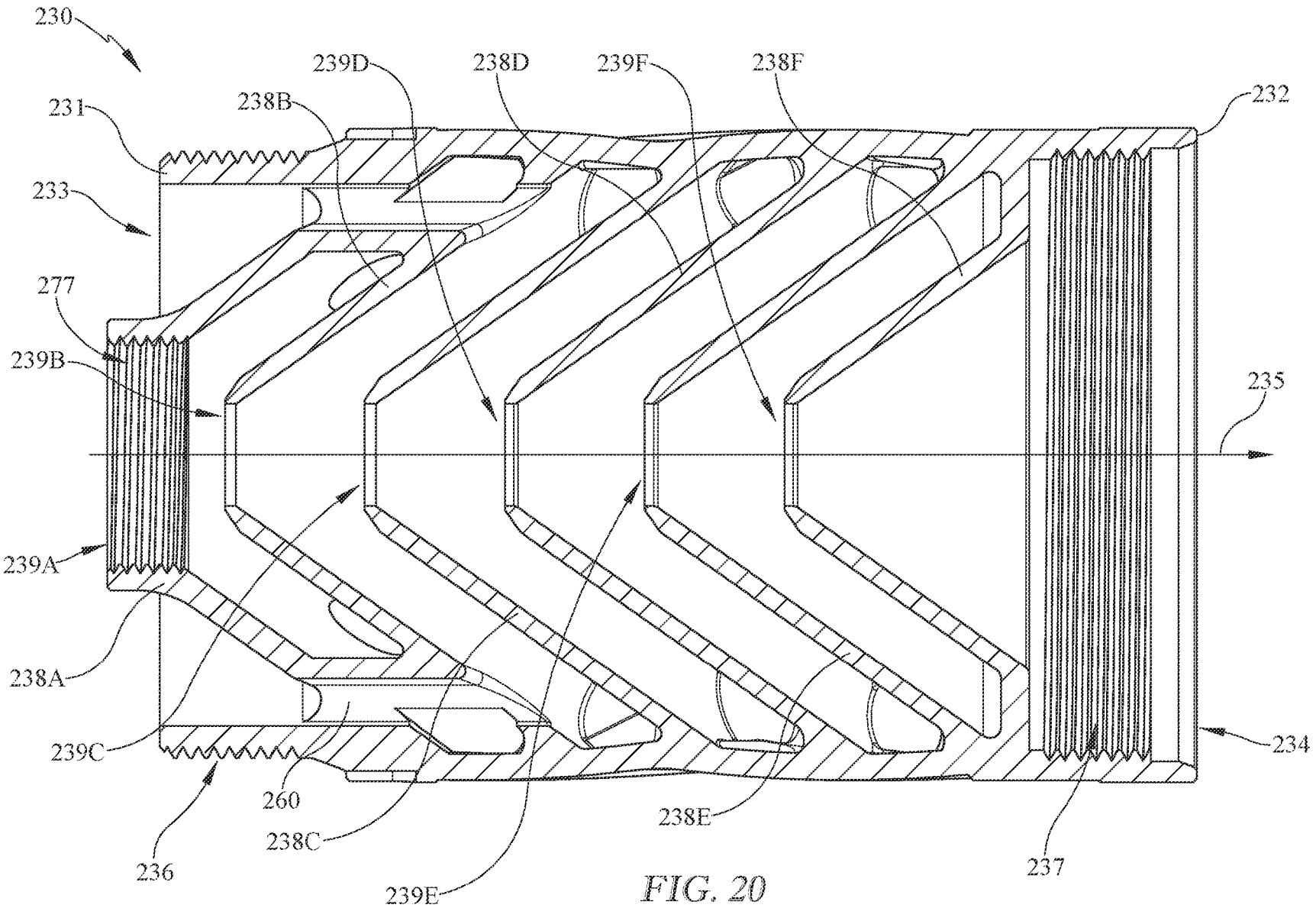

FIG. 20 is a cross-sectional view of an embodiment of a second module 230. The second module 230 has a first end 231 and a second end 232. The second module 230 may be connected to the first module 220 via external threads 236 that engage the second internal threads 228 of the first module 220. The second module 230 includes a fifth central opening 233 and a sixth central opening 234 with a third central pathway 235 through the second module 230 from the fifth central opening 233 to the sixth central opening 234. The second module 230 includes a plurality of internal baffles 238A-238F positioned along the third central pathway 235 between the fifth central opening 233 and the sixth central opening 234. Each baffle 238A-238F includes a central aperture 239A-239F that is aligned with and forms the third central pathway 235. The third central pathway 235 is aligned with the second central pathway 225 of the first module 220 when the second module 230 is connected to the first module 220. The central opening 239A of the first baffle 238A includes internal threads 277 which are configured to receive the blast baffle 270. The blast baffle 270 may be replaced if necessary due to wear and tear caused by repeated use of the firearm suppressor 200.

The second module 230 includes at least one peripheral pathway 260. The at least one peripheral pathway 260 is not coaxially aligned with the third central pathway 235. The at least one peripheral pathway 260 bypasses a second baffle 238B of the plurality of baffles 238A-238F by fluidly connecting an exterior of a first baffle 238A with an exterior of the third baffle 238C as shown in FIG. 20. The second module 230 include internal threads 237 that enable the second module 230 to be connected to other components of the firearm suppressor 200. For example, the end cap 250 may be connected to the second end 232 of the second module 230 or alternatively, a modular baffle 240A may be connected to the second end 232 of the second module 230. The size, shape, number, and/or configuration of the internal baffles 238A-238F are shown for illustrative purposes and may be varied as would be appreciated by one of ordinary skill in the art having the benefit of this disclosure. For example, there may be more or less internal baffles 238A-238F as shown in FIG. 20.

Figure 21:
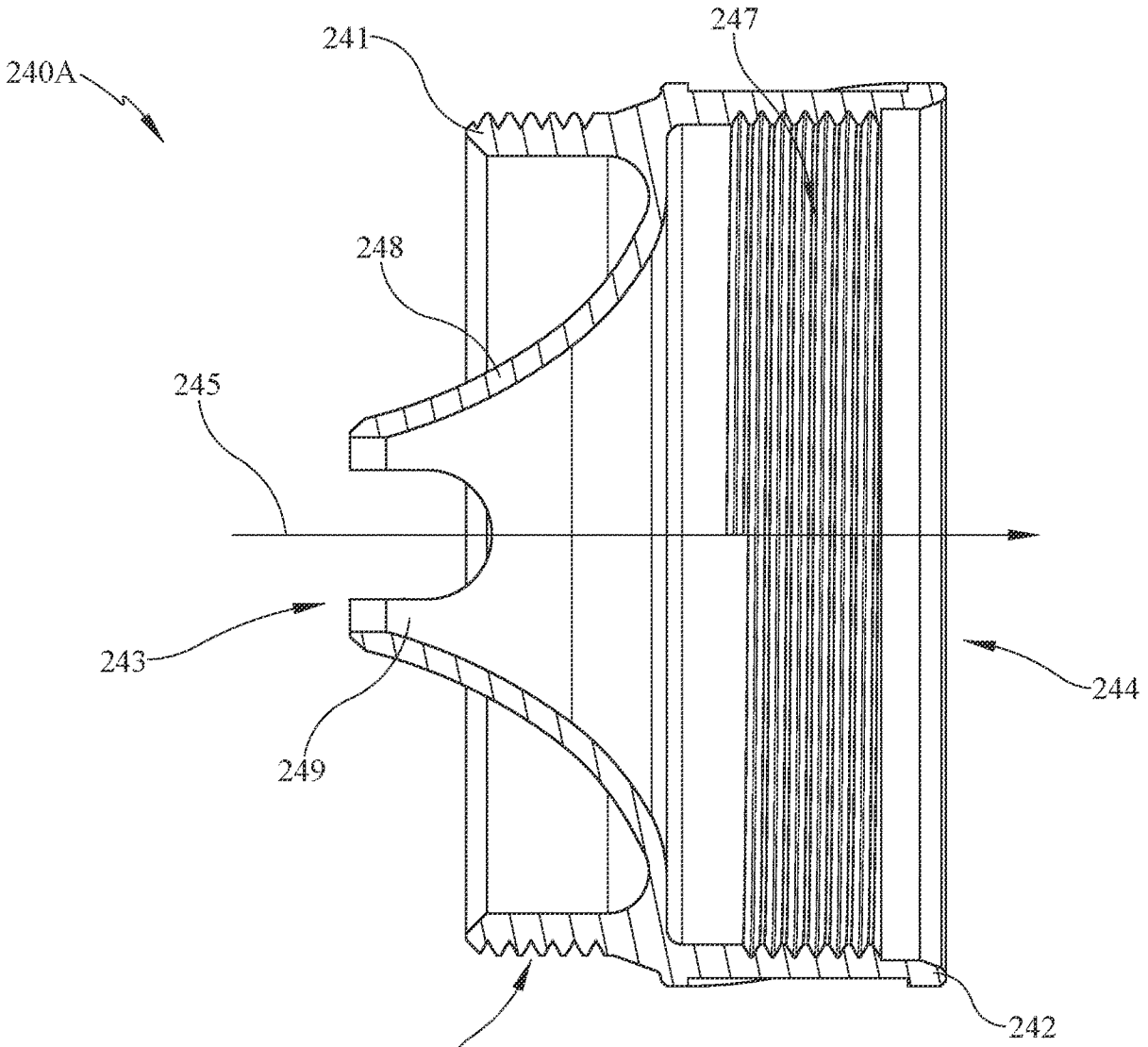

FIG. 21 is a cross-sectional view of an embodiment of a first modular baffle 240A. The modular baffle 240A includes a first end 241 and a second end 242. The modular baffle 240A has a first central opening 243 and a second central opening 244 with a central pathway 245 extending from the first central opening 243 to the second central opening 244. The modular baffle 240A includes external threads 246 to enable the modular baffle 240A to be connected to another the second module 230 or another modular baffle such as a second modular baffle 240B. The modular baffle 240A includes internal threads 247 that enable the modular baffle 240A to be connected to the end cap 250 or another modular baffle. The modular baffle 240A includes a cone 248 as would be appreciated by one of ordinary skill in the art having the benefit of this disclosure. The cone 248 may be clipped 249 as shown and as would be appreciated by one of ordinary skill in the art having the benefit of this disclosure.

Figure 22:
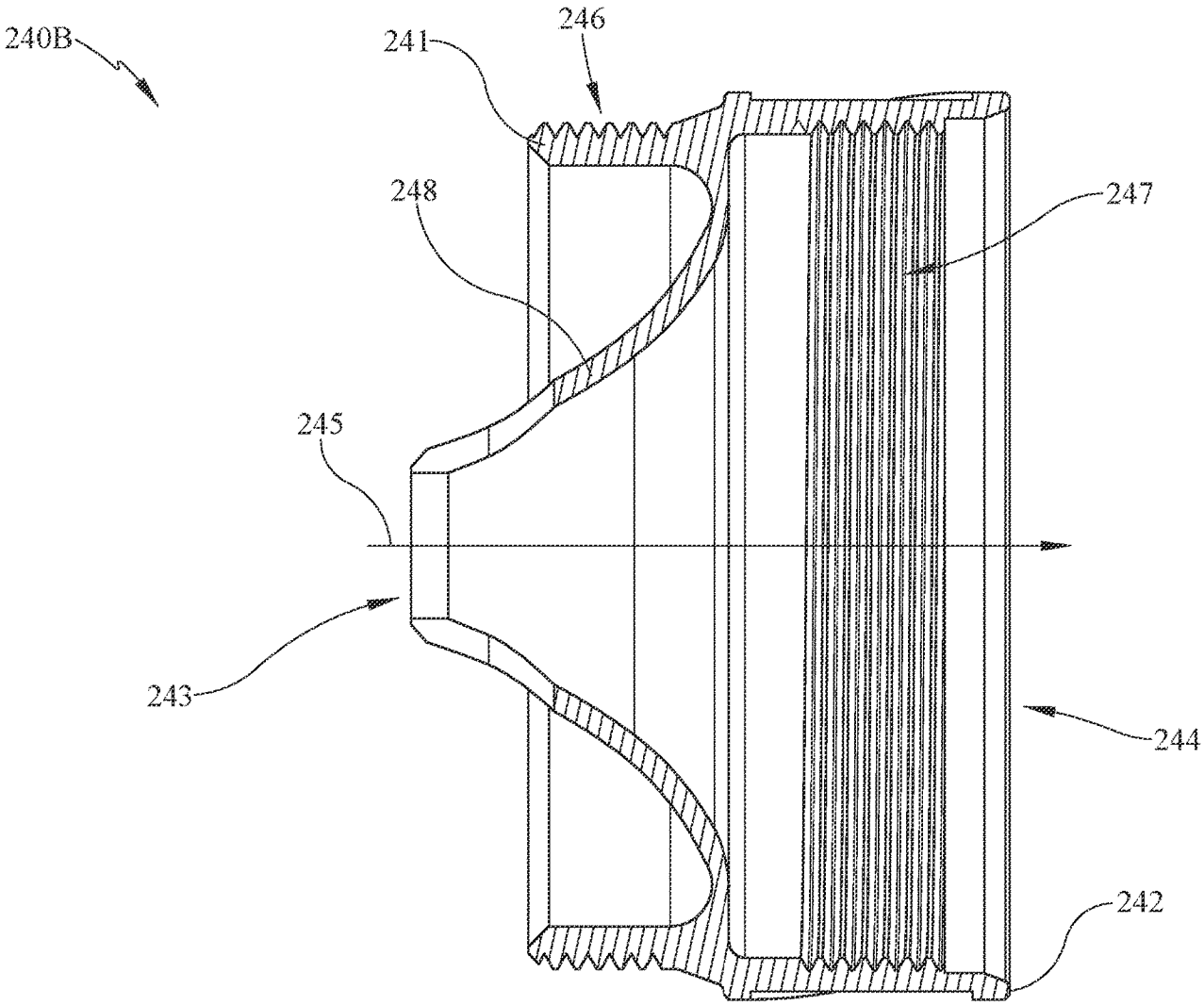

FIG. 22 is a cross-sectional view of an embodiment of a second modular baffle 240B. The modular baffle 240B includes a first end 241 and a second end 242. The modular baffle 240B has a first central opening 243 and a second central opening 244 with a central pathway 245 extending from the first central opening 243 to the second central opening 244. The modular baffle 240B includes external threads 246 to enable the modular baffle 240B to be connected to the second module 230 or to another modular baffle. The modular baffle 240B includes internal threads 247 that enable the modular baffle 240B to be connected to the end cap 250 or another modular baffle. The modular baffle 240B includes a cone 248 as would be appreciated by one of ordinary skill in the art having the benefit of this disclosure.

Figure 23:
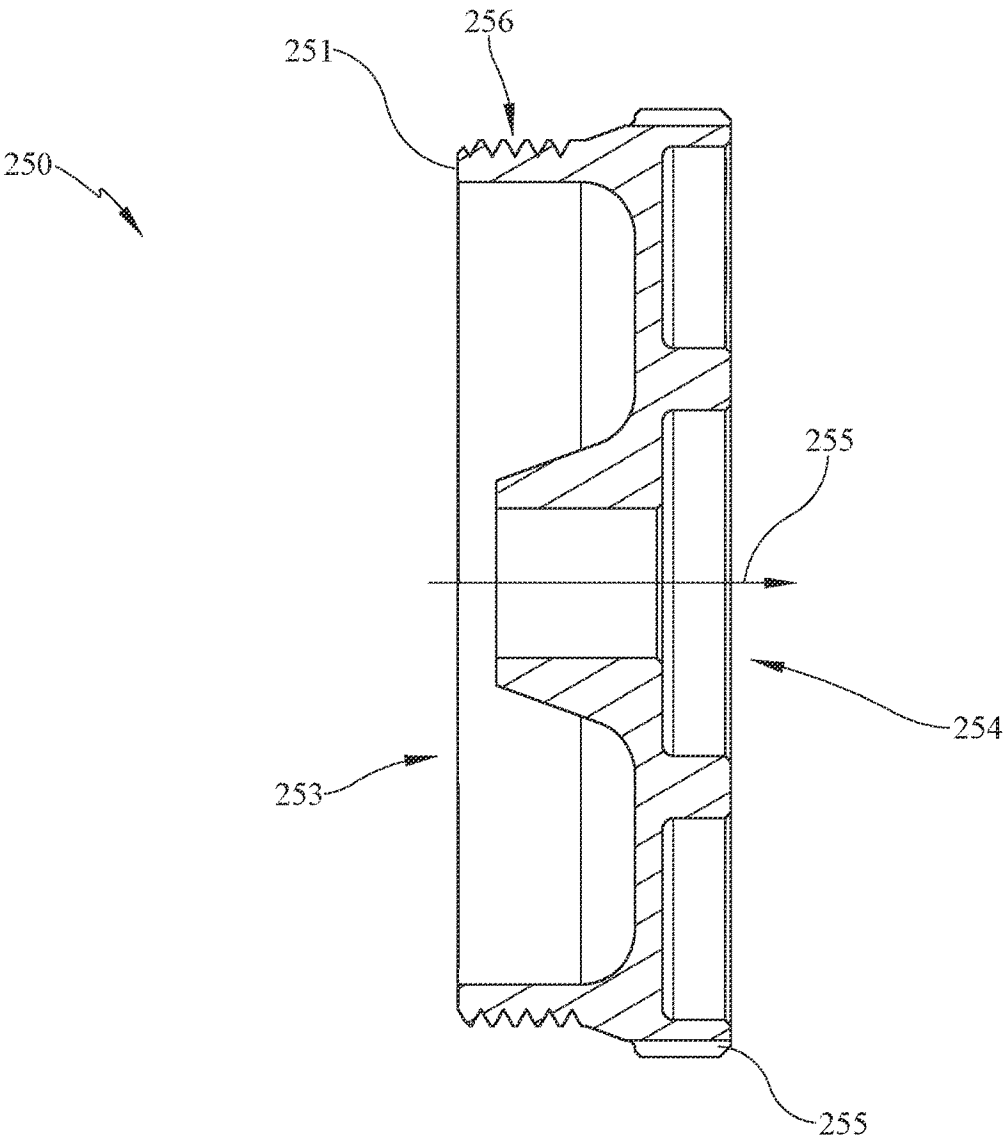

FIG. 23 is a cross-sectional view of an embodiment of an end cap 250. The end cap 250 includes a first end 251 and a second end 252. The end cap 250 has a seventh central opening 253 and an eighth central opening 254 with a fourth central pathway 255 through the end cap 250 from the seventh central opening 253 to the eighth central opening 254. The fourth central pathway 255 is aligned with the third central pathway 235 of the second module 230 when connected together. The end cap 250 includes external threads 256 that enable the end cap 250 to be connected directly to the internal threads 237 of the second module 230. Alternatively, the end cap 250 may be connected to a modular baffle 240A, 240B via the external threads 256.

As discussed herein, the firearm suppressor 200 may include components that are formed via additive manufacturing processes, such as but not limited to, 3D printing and the firearm suppressor 200 may include components that are formed via machining processes. For example, the first module 220 and the second module 230 of the firearm suppressor 200 may be formed via additive manufacturing processes whereas as the mount 210, modular baffles 240A-240B, and the end cap 250 may be formed via typical machining processes. The use of additive manufacturing enables the internal baffles 238A-238F to be formed at different spacing and/or angles. The use of two different manufacturing processes enables the firearm suppressor to be formed with differently shaped and configured baffles. The second module 230 ensures that a minimum number of baffles will be used along that length of the suppressor in comparison to a totally modular suppressor. A totally modular suppressor may enable an end user to reduce the total number of baffles to be less than the manufacturers' recommendation. For example, a user could remove modular baffles to just a couple or even one baffle, which may drastically affect the performance of the suppressor. The second module 230 of this disclosure ensures an adequate number of baffles will be used at a minimum while enabling the end user to reconfigure with the modular baffles 240A-240B.

The threads 216, 227, 228, 236, 237, 246, 247, 256, 277 on each component of the firearm suppressor 200 may be configured to create a taper lock between tapered edges of components. The taper lock may prevent or reduce the chance that the components would inadvertently come apart or separate during repeated discharges of a firearm connected to the firearm suppressor 200.

Although this invention has been described in terms of certain embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A firearm suppressor comprising:

a mount having a first central opening and a second central opening with a first central pathway through the mount from the first central opening to the second central opening, the mount configured to be connected to a barrel of a firearm, the first central pathway configured to be aligned with a bore of the barrel;

a first module, the first module connected to the mount, the first module having a third central opening and a fourth central opening with a second central pathway through the first module from the third central opening to the fourth central opening, the interior of the first module being a first chamber, wherein the first module does not include a baffle and wherein the second central pathway is aligned with the first central pathway;

a second module, the second module connected to the first module, the second module having a fifth central opening and a sixth central opening with a third central pathway through the second module from the fifth central opening to the sixth central opening, the second module having a plurality of baffles positioned along the third central pathway between the fifth central opening and the sixth central opening with each baffle of the plurality of baffles having a central aperture aligned with the third central pathway, a first baffle of said plurality of baffles of said second module extending a distance beyond said fifth central opening and into said first module, wherein said plurality of baffles of said second module are linear, the third central pathway being aligned with the second central pathway, the second module includes at least one peripheral pathway, the at least one peripheral pathway is not coaxially aligned with the third central pathway and the at least one peripheral pathway bypasses a second baffle of the plurality of baffles by fluidly connecting an exterior of said first baffle of the plurality of baffles with an exterior of a third baffle of the plurality of baffles; and an end cap, the end cap connected to the second module, the end cap having a seventh central opening and an eighth central opening with a fourth central pathway through the end cap from the seventh central opening to the eighth central opening, the fourth central pathway being aligned with the third central pathway;

each of said mount, said first module, and said second module having a thread and a locking surface wherein said thread of said mount engages said first module before said locking surface of said mount, and wherein said thread of said second module engages said first module before said locking surface of said second module so as to maintain alignment of said mount, said first module and said second module.

2. The firearm suppressor of claim 1, wherein the second module is formed via additive manufacturing.

3. The firearm suppressor of claim 2, wherein the plurality of baffles within the second module comprises at least five baffles.

4. The firearm suppressor of claim 2, wherein the plurality of baffles within the second module comprises at least nine baffles.

5. The firearm suppressor of claim 1, further comprising a first modular baffle, the first modular baffle connected between the end cap and the second module, said first modular baffle comprising a cone with curvilinear walls.

6. The firearm suppressor of claim 5, wherein the first modular baffle is connected to the second module via threads and further comprise a taper lock between a tapered locking surface of the first modular baffle and a tapered engagement surface of the second module.

7. The firearm suppressor of claim 5, further comprising a second modular baffle, the second modular baffle connected between the first modular baffle and the end cap.

8. The firearm suppressor of claim 7, further comprising a third modular baffle, the third modular baffle connected between the second modular baffle and the end cap.

9. The firearm suppressor of claim 8, further comprising a fourth modular baffle, the fourth modular baffle connected between the third modular baffle and the end cap.

10. The firearm suppressor of claim 9, wherein the first module and the second module are formed by additive manufacturing process and the end cap, the first modular baffle, the second modular baffle, the third modular baffle, and the fourth modular baffle are formed by a machining process.

11. The firearm suppressor of claim 1, wherein the mount is connected to the first module via said threads configured to create a taper lock, wherein the first module is connected to the second module via said threads and a taper lock is created between tapered edges of the first module and the second module, and wherein the second module is connected to the end cap via said threads and a taper lock is created between tapered edges of the second module and the end cap.

12. The firearm suppressor of claim 1, further comprising a blast baffle, wherein the blast baffle is threadedly connected to the first baffle of the plurality of baffles within the second module.

13. A firearm suppressor comprising:

a mount having a first central opening and a second central opening with a first central pathway through the mount from the first central opening to the second central opening, the mount configured to be connected to a barrel of a firearm, the first central pathway configured to be aligned with a bore of the barrel;

a first module, the first module connected to the mount, the first module having a third central opening and a fourth central opening with a second central pathway through the first module from the third central opening to the fourth central opening, the interior of the first module being a first chamber, wherein the first module does not include a baffle and wherein the second central pathway is aligned with the first central pathway;

a second module, the second module connected to the first module, the second module having a fifth central opening and a sixth central opening with a third central pathway through the second module from the fifth central opening to the sixth central opening, the second module having a plurality of baffles positioned along the third central pathway between the fifth central opening and the sixth central opening with each baffle of the plurality of baffles having linear walls and a central aperture aligned with the third central pathway, the third central pathway being aligned with the second central pathway, the second module includes at least one peripheral pathway, the at least one peripheral pathway is not coaxially aligned with the third central pathway and the at least one peripheral pathway bypasses a second baffle of the plurality of baffles by fluidly connecting an exterior of a first baffle of the plurality of baffles with an exterior of a third baffle of the plurality of baffles, such that at least two of said plurality of baffles have differing shapes from the third baffle of the plurality of baffles;

at least one modular baffle disposed at said sixth central opening, said at least one modular baffle having an internal cone of curved shaped wall;

an end cap, the end cap connected to the second module, the end cap having a seventh central opening and an eighth central opening with a fourth central pathway through the end cap from the seventh central opening to the eighth central opening, the fourth central pathway being aligned with the third central pathway;

wherein one of said first module or said second module have two internal threads and a tapered locking surface adjacent to each of said two internal threads, said tapered locking surfaces located forward of the two internal threads in a direction of engagement.

14. The firearm suppressor of claim 13, wherein threads of said mount and said second module are external threads that engage internal threads of said first module.

15. The firearm suppressor of claim 14, said taper locking surfaces of said mount and said second module being rearward of said threads in a direction of engagement.

* * * * *